US005816793A

United States Patent [19]

Nakamoto et al.

[11] Patent Number: 5,816,793

[45] Date of Patent: Oct. 6, 1998

[54] COMBUSTION APPARATUS

[75] Inventors: Mitsuyoshi Nakamoto, Nara; Hirohisa Kato, Ibaraki; Kenkichi Hashido, Nara; Takashi Nishikawa, Tenri; Hideharu Sano, Kyoto; Satoru Nitta, Nara, all of Japan

[73] Assignee: Matsushita Electric Industrial Co., Ltd., Osaka, Japan

[21] Appl. No.: 457,384

[22] Filed: Jun. 1, 1995

[30] Foreign Application Priority Data

| | | | |
|---|---|---|---|
| Jun. 1, 1994 | [JP] | Japan | 6-120444 |
| Jun. 8, 1994 | [JP] | Japan | 6-126465 |
| Jul. 8, 1994 | [JP] | Japan | 6-157671 |
| Aug. 19, 1994 | [JP] | Japan | 6-195291 |

[51] Int. Cl.[6] ..... F23D 21/00

[52] U.S. Cl. ..... 431/114; 431/1; 431/346; 431/328

[58] Field of Search ..... 431/114, 1, 346, 431/328

[56] References Cited

U.S. PATENT DOCUMENTS

| | | | |
|---|---|---|---|
| 3,601,985 | 8/1971 | Bauger | 431/114 |
| 3,748,085 | 7/1973 | Poepsel et al. | 431/114 |
| 3,907,489 | 9/1975 | Santisi | 431/114 |
| 3,947,226 | 3/1976 | Neumann et al. | 431/114 |
| 4,045,157 | 8/1977 | Peterson | 431/114 |
| 4,168,948 | 9/1979 | Okamoto et al. | 431/114 |
| 4,476,850 | 10/1984 | Pickering | 431/114 X |
| 4,477,246 | 10/1984 | Hisaoka et al. | 431/114 |
| 5,403,180 | 4/1995 | Chato | 431/1 |

FOREIGN PATENT DOCUMENTS

| | | | |
|---|---|---|---|
| 3508778 | 9/1986 | Germany | 431/114 |

*Primary Examiner*—Larry Jones
*Attorney, Agent, or Firm*—Ratner & Prestia

[57] ABSTRACT

The invention is intended to suppress oscillatory combustion of a combustion apparatus. In the invention, acoustic closed ends are provided at an inlet side and an outlet side of the burner port unit, and the combustion apparatus is constituted so that the flame may be positioned between these closed ends, and a buffer chamber is provided at the inlet side. Thus, when the inlet side and outlet side of the burner port unit of the combustion apparatus are formed as acoustic closed ends, oscillatory combustion occurs easily. At this time, when the intake tube communicates at the upstream side of the inlet side closed end, and an exhaust tube communicates at the downstream side of the outlet side closed end, if the length of the intake tube and exhaust tube is changed, the air ratio and combustion amount for generating oscillatory combustion remain constant, and the oscillation frequency and oscillation pressure remain constant. In such condition, when a sound absorbing unit is provided in the buffer chamber, oscillation does not occur, and if the intake tube or exhaust tube is extended, oscillation does not occur.

45 Claims, 29 Drawing Sheets

Sound absorbing characteristic of sound absorbing member (sound absorption rate)

COMBUSTION APPARATUS

BACKGROUND OF THE INVENTION

1. Field of the Invention

The present invention relates to a combustion apparatus for industrial and commercial use, and more particularly to a combustion apparatus capable of preventing oscillatory combustion.

2. Description of the Prior Art

Recently, in the combustion apparatus for industrial and commercial use, there are increasing demands for reduction of size, decrease of emission of NOx or HC in order to make the combustion gas clean, and expansion of turndown ratio (variable width of fuel supply amount). To satisfy these demands, it has been requested to burn at high load or burn near the flammable limit. As a result, variations of flame shape become large, and oscillatory combustion often took place.

Concerning such oscillatory combustion, an example of combustion apparatus of conventional forced feed and exhaust type (also known as FF combustion apparatus) is described below. FIG. 29 is a structural diagram of a combustion apparatus of a conventional FF type space heater.

As shown in the drawing, air is supplied from an intake-exhaust top 1001, passes through an intake tube 1002, and is sent into the space between a motor 1003 and a motor case 1005. Further, the air is sent into a fan 1006 along a motor shaft 1004, and pressurized and forwarded into a mixer 1007. Herein, the air is mixed with a fuel to form a premixed gas, which is sent into a burner 1008. The premixed gas burns in the burner 1008 to be a combustion gas, and the combustion gas is released to outside through a combustion tube 1009, a return head 1010, a heat exchanger 1011, an exhaust tube 1012, and the intake-exhaust top 1001.

In such constitution of combustion apparatus, pressure fluctuations occurring on the flame surface of the burner 1008 during combustion form pressure waves, which progress toward the upstream side of the burner 1008, that is, toward the intake side. In consequence, the pressure waves collide against the wall of the motor case 1005, and this surface is the closed end and the pressure waves are reflected. The reflected pressure waves influence the flames again, provoking new pressure fluctuations.

On the other hand, the pressure waves occurring on the flame surface also advance to the downstream side of the burner, that is, in the axial direction of the combustion tube 1009 at the same time. Likewise, the pressure waves collide against the wall of the return header 1010, and this surface is the closed end and the pressure waves are reflected. The reflected pressure waves influence the flames again, provoking new pressure fluctuations.

Therefore, pressure fluctuations by pressure waves at a frequency coinciding with the acoustic characteristic of the combustion apparatus are fed back, and amplified to cause oscillatory combustion, and such oscillatory combustion occurring in relation to the combustion conditions and other circumstances cause to release noise and oscillations from the combustion apparatus.

Hitherto, as the means for preventing such oscillatory combustion, it has been attempted to weaken the combustion reaction by extending the flame or increasing the area of the burner ports by adjusting the premixing rate of fuel and air in premixed combustion. Moreover, it has been also attempted to increase the resistance of flow in the combustion apparatus, insert a oscillation absorbing material, or install a silencer.

However, from the viewpoint of high load combustion and low NOx combustion, short flame is advantageous, or for the purpose of high load combustion only, the area of the burner ports is preferred to be smaller, and hence it has been difficult to suppress oscillatory combustion by these methods of preventing oscillatory combustion. In particular, in the combustion apparatus of forced feed and exhaust type for varying the length of intake and exhaust tube, or in the combustion apparatus using a chimney, when the length of intake and exhaust tube or chimney varies, the frequency of an oscillation and the pressure level of the oscillation change, or oscillatory combustion occurs or does not occur depending on the case. It was hence more difficult to prevent oscillatory combustion.

Considering such problems of the conventional combustion apparatus, it is hence a primary object of the invention to prevent oscillatory combustion resulting from enhancement of performance of combustion apparatus such as high load combustion and low NOx combustion.

SUMMARY OF THE INVENTION

To achieve the object, the invention provides a combustion apparatus comprising a combustion section composed of a combustion chamber and a burner port unit, a blower for supplying combustion air into the combustion section, an intake tube connected to the blower side, an exhaust tube connected to the combustion section side, an inlet reflection surface provided at the upstream side of the burner port unit, and an outlet reflection surface provided at the downstream side of the combustion chamber, wherein the inlet reflection surface and outlet reflection surface are configured so that the sympathetic frequency of the acoustic space formed between the both reflection surfaces may not be substantially influenced by changes of size or length of the intake tube and/or exhaust tube, and sound absorbing means for absorbing sound of specific frequency defined by the sympathetic frequency of the acoustic space is provided in the inlet reflection surface and/or outlet reflection surface.

In the invention, the combustion section is composed of the combustion chamber and burner port unit, the blower supplies combustion air into the combustion section, the intake tube is connected to the lower side, the exhaust tube is connected to the combustion unit side, the inlet reflection surface is provided at the upstream side of the burner port unit, the outlet reflection surface is provided at the downstream side of the combustion chamber, the inlet reflection surface and outlet reflection surface are configured so that the sympathetic frequency of the acoustic space formed between the both reflection surfaces may not be substantially influenced by changes of size or length of the intake tube and/or exhaust tube, and the sound absorbing means provided in the inlet reflection surface and/or outlet reflection surface absorbs sound of specific frequency defined by the sympathetic frequency of the acoustic space. Thereby the oscillatory combustion is decreased.

Also in the invention, for example, acoustic closed ends are formed at the inlet side and outlet side of the combustion section of the combustion apparatus, and the combustion apparatus is constituted so that the flames may be positioned at these closed ends, and an inlet buffer chamber is provided at the inlet side. The inlet buffer chamber comprises a sound absorption unit composed of sound absorbing material. Hence the oscillatory combustion is decreased.

Also in the invention, for example, acoustic closed ends are formed at the inlet side and outlet side of the combustion section of the combustion apparatus, and the combustion apparatus is constituted so that the flames may be positioned at these closed ends, and a sound absorbing mechanism of Helmholtz type is provided at the acoustic closed end of the inlet side and/or outlet side. By this sound absorbing mechanism, the sound of specific frequency defined by the sympathetic frequency in the acoustic space is absorbed, and the oscillatory combustion is decreased.

Also in the invention, a throttle is provided between the sound absorbing unit and fan. The sectional area of the burner port unit is smallest in the combustion unit, and a vaporizing unit of liquid fuel is a rotary type vaporizer having a small flow resistance. The sectional area of the burner port unit is smallest in the combustion unit.

Moreover, an acoustic closed end is provided at the inlet side of the combustion unit of the combustion apparatus, and burner ports are projected from the closed end into the combustion chamber to compose the combustion apparatus, and an inlet buffer chamber is provided at the inlet side. A throttle is provided between the inlet buffer chamber and fan. A vaporizing unit of liquid fuel is a rotary type vaporizer having a small flow resistance.

In the invention, for example, the outlet reflection surface is provided in the combustion gas passage at the downstream side of the combustion chamber, and a specific gap is formed against the wall of the combustion gas passage.

Also in the invention, for example, the outlet reflection surface has a concave surface, and the combustion chamber is located at the concave surface side.

Thus, since, for example, the concave-shaped outlet reflection surface is provided, the reflection of the sympathetic frequency in the acoustic space can be increased on the outlet reflection surface, and the specific frequency for generating oscillatory combustion is effectively absorbed by the sound absorbing means, so that the oscillatory combustion is decreased.

Incidentally, Rayleigh and Putnam reported that the generation condition of oscillatory combustion in combustion apparatus can be judged from the acoustic characteristic of the combustion apparatus. They disclosed that oscillation occurs when there is a flame between the node and antinode of pressure, and does not occur when there is a flame between antinode and node of pressure. This oscillation condition is accepted. Falling in this oscillation condition, however, oscillation may not occur if the fluctuation is small. When a oscillation is given from outside, a stationary wave is generated by the constitution of the combustion apparatus. At this time, when the flame is in non-oscillation condition, the oscillation attenuates and the stationary wave stops. When the antinode of the pressure is removed by the combustion plate in the primary combustion chamber, the flame is positioned at the downstream side of the antinode of oscillation, and hence oscillation hardly occurs, and if the intake tube is extended, oscillation does not occur. Moreover, when a buffer chamber is provided at the acoustic closed end of the inlet side and a throttle is provided between the buffer chamber and fan, the entire inlet buffer chamber comes to the antinode of pressure. If the intake tube is installed in the buffer chamber, the position of the antinode is unchanged. At this time, the flame is present between the antinode and node of pressure, and hence oscillation occurs very rarely.

In the invention, for example, when the inlet side and outlet side of the burner port unit of the combustion apparatus are formed as acoustic closed ends, oscillatory combustion occurs easily. At this time, when the intake tube communicates with the upstream side of the inlet side closed end and the exhaust tube with the downstream side of the outlet side closed end, if the length of the intake tube and exhaust tube is changed, the air ratio and combustion amount for inducing oscillatory combustion are invariable, and the oscillation frequency and oscillation pressure are also constant. In such condition, when a sound absorbing material is provided at the inlet side acoustic closed end, oscillation does not occur, or if the intake tube and exhaust tube are extended, oscillation does not take place.

Moreover, for example, when the sectional area of the burner port unit is smallest in the combustion section, oscillation occurs, being at the antinode at the outlet reflection plate and antinode at the combustion plate, and the oscillation frequency can be heightened. The higher the oscillation frequency, the easier it is to prevent oscillation.

Still more, when a throttle is provided between the sound absorbing unit and the fan, the antinode of oscillation pressure is formed in the entire inlet buffer chamber, so that it is easy to prevent oscillation.

REFERENCE NUMERALS

Figure 1:
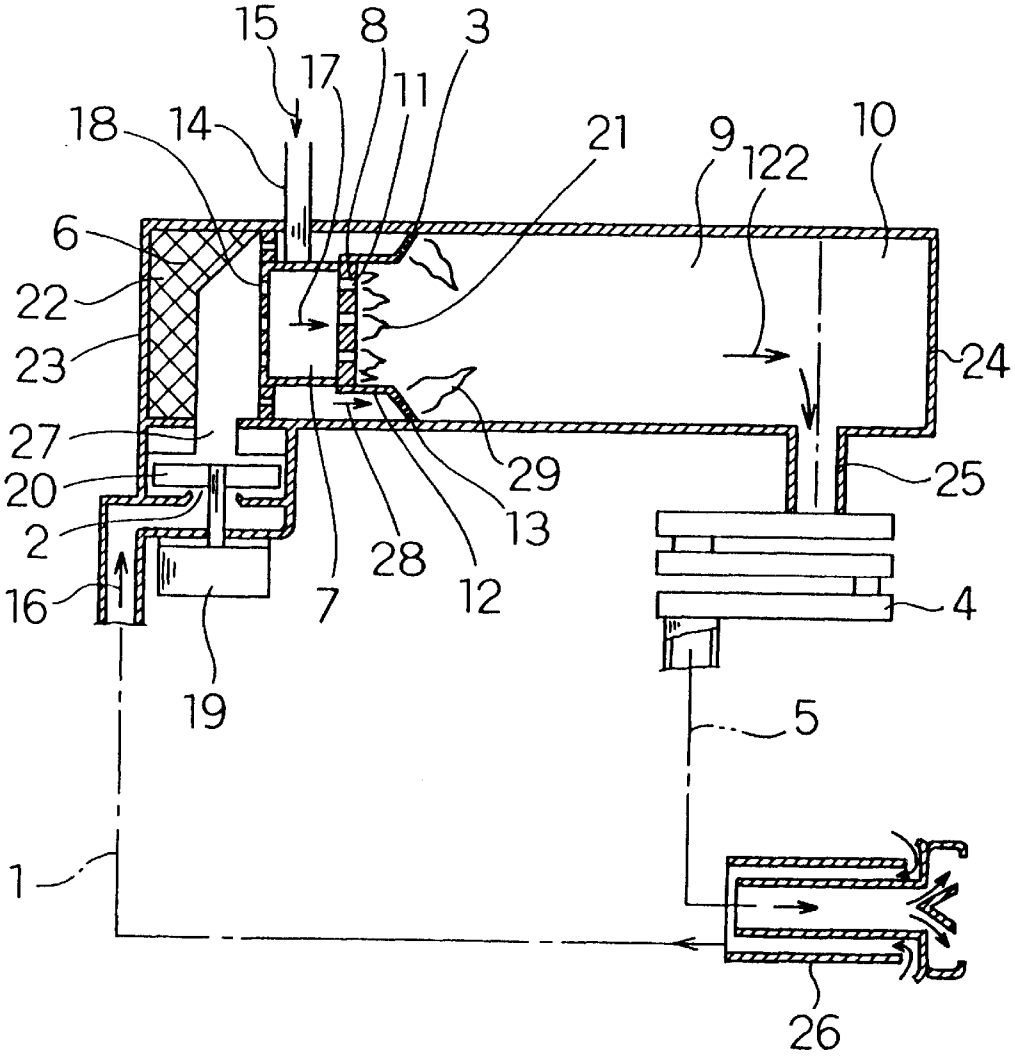
FIG. 1 is a sectional view of an embodiment of the invention.

1 Intake unit
2 Blower unit
3 Combustion section
4 Heat exchanger
5 Exhaust unit
10 Outlet buffer chamber
11 Burner port
21 Premixed flame
22 Inlet sound absorbing unit
23 Inlet reflection surface
24 Outlet reflection surface
101 Intake tube
102 Blower unit
103 Combustion section
104 Heat exchanger
105 Exhaust tube
106 Motor case
107 Throttle
108 Fan
109 Fan case
100 Vaporizing cylinder
110 Heater
120 Mixing chamber
130 Rotary
140 Fuel supply path
150 Burner port unit
160 Combustion plate
170 Combustion tube
180 Combustion chamber
190 Primary combustion chamber
200 Secondary combustion chamber
230 Secondary air vent
240 Liquid fuel
250 Premixed gas
251 Combustion air
270 Motor
280 Inlet buffer chamber
300 Secondary air
305 Communication cylinder
310 Secondary flame
311 Premixed flame
330 Inlet reflection surface
340 Inlet sound absorbing unit
1001 Intake-exhaust tube
1002 Intake tube
1003 Motor
1004 Motor shaft
1005 Motor case
1006 Fan
1007 Mixer
1008 Burner
1000 Combustion tube
1010 Return header
1011 Heat exchanger
1012 Exhaust tube
1101 Opening a
1102 Closed space b
1103 Opening c
1104 Closed space d
1105 Space forming member a
1106 Space forming member b
1201 Opening g
1202 Notch disk
1203 Path defining plate
1301 Sound absorbing rubber
1302 Air path
1401 Opening h
1402 Space I
1403 Plate member
1501 Ceramic wool
1601 Punching metal
1602 Flow shielding plate
1603 Space j
1604 Space k
1605 Opening m
1606 Opening n
2210 Return header
2220 Outlet reflection surface
2221 Porous piece
2222 Gap
2225 Outlet second reflection surface

EMBODIMENTS

Referring now to the drawings, embodiments of the invention are described in detail below.

In the following embodiments, a sound absorbing material or the like is used as the sound absorbing means of the invention.

(Embodiment 1)

FIG. 1 is a sectional detail view of an embodiment of a combustion apparatus of the invention.

The combustion apparatus consists of an intake tube 1, a blower 2, a combustion section 3, a heat exchanger 4, and an exhaust tube 5. The combustion section 3 comprises an inlet buffer chamber 6, a mixing chamber 7, a burner port unit 8, a combustion chamber 9, and an outlet buffer chamber 10. Herein, the buffer chamber is either the partitioned portion such as the inlet buffer chamber 6, or part of a single space not partitioned such as the outlet buffer chamber 10. Multiple burner ports 11 are pierced in the burner port unit 8, and a combustion plate 12 is installed in the circumference, and a secondary air vent 13 is provided. In the downstream part of the combustion plate 12, the combustion chamber 9 and outlet buffer chamber 10 are installed. A fuel supply path 14 is connected to the mixing chamber 7, from which a fuel 15 is supplied into the mixing chamber 7. The fuel 15 and combustion air 16 are mixed in the mixing chamber 7, and a premixed gas 17 is prepared. The combustion air 16 flows into the mixing chamber 7 through an air intake port 18.

The blower 2 comprises a motor 19 and a fan 20, and the combustion air 16 is inhaled from the intake tube 1 by the fan 20 driven by the motor 19, and passes through the inlet buffer chamber 6 and is mixed with the fuel 15 in the mixing chamber 7. The premixed gas 17 flows into the combustion chamber 9 through burner ports 11, and is ignited to form a premixed flame 21. Combustion gas 122 heated to high temperature is partly heat exchanged with the wall of the combustion chamber 9, and is further heat exchanged when passing through the heat exchanger 4, and is released to the atmosphere at low temperature through the exhaust tube 5.

The bottom (upper left side in drawing) of the inlet buffer chamber 6 is an inlet reflection surface 23. In the inlet buffer chamber 6, an inlet sound absorbing unit 22 composed of sound absorbing material is provided. The downstream side of the combustion chamber 9 is the outlet buffer chamber 10, and its bottom (upper right side in drawing) is an outlet reflection surface 24. The inlet of inlet buffer chamber 6 and outlet of outlet buffer chamber 10 are nearly vertical to the inlet reflection surface 23 and outlet reflection surface 24, and their sectional area is preferred to be as small as possible. The combustion chamber 9 and heat exchanger 4 are connected through a communication tube 25. The communication tube 25 is provided almost vertically to the outlet reflection surface 24. To form the outlet reflection surface 24 as a closed end acoustically, the sectional area of the communication tube 25 should be as small as possible. If too small, however, the flow resistance of the combustion gas 122 increases, and the noise is raised for increasing the capacity of the blower 2. Hence the sectional area must be maintained so as to satisfy the closed end.

At the outlet of the heat exchanger 4, the exhaust tube 5 is connected, and an intake-exhaust cylinder 26 is connected to the other end of the exhaust tube 5. The intake-exhaust cylinder 26 is coaxial so that the intake tube 1 may be outside and exhaust tube 5 outside, and low temperature combustion air 16 flows outside and high temperature combustion exhaust gas 122 inside. In this case, the intake tube 1 and exhaust tube 5 are adjustable in length, and their ends are open ends acoustically. In the combustion apparatus of the embodiment, generation of oscillation can be suppressed regardless of the length of the intake tube and exhaust tube 5.

The inlet buffer chamber 6 and fan 20 are connected through an intake hole 27. The intake tube 1 is connected to the inlet of the fan 20, and the intake tube 1 is variable in length, and is connected to the outside of the intake-exhaust cylinder 26. The intake hole 27 is positioned nearly at right angle to the vertical direction of the inlet reflection surface 23.

When the premixed gas 17 is ignited in the burner port unit 8, the premixed flame 21 is formed. At the downstream side of the combustion plate 12, multiple secondary air vents 13 are pierced, and secondary air 28 is supplied from the secondary air vents 13, thereby forming a secondary flame 29 which diffuses and burns. After complete combustion in the combustion chamber 9, the combustion gas 23 passes through the outlet buffer chamber 10 and communication tube 25, and flows into the heat exchanger 4.

Figure 2:
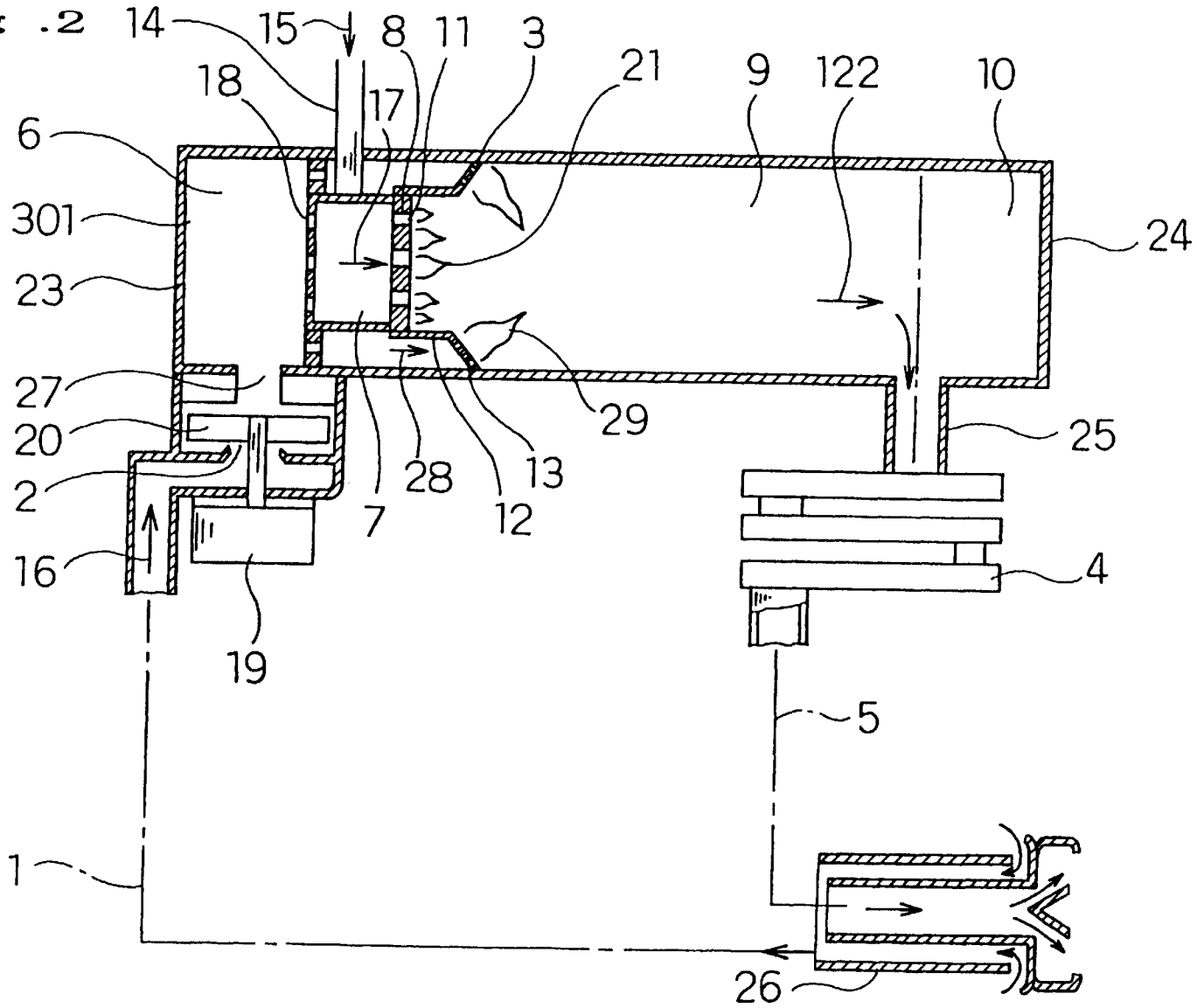
FIG. 2 is an explanatory sectional view of the embodiment.
Figure 12A:
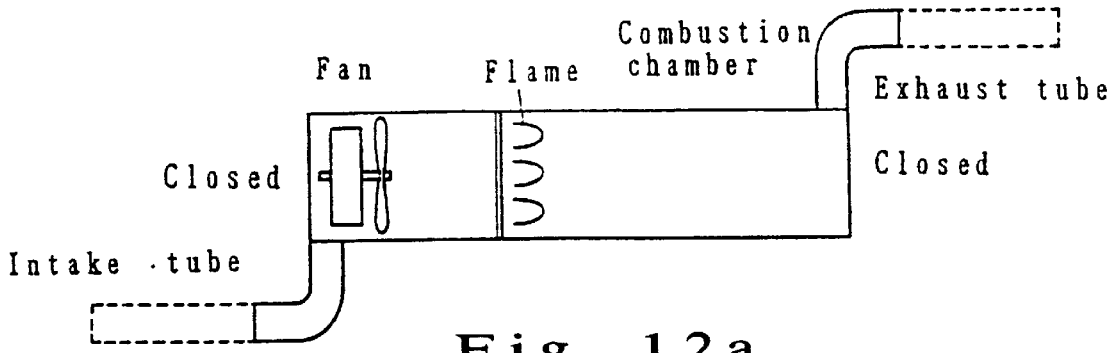
FIGS. 12*a* and 12*b* (referred to collectively as FIG. 12) are diagrams for explaining the acoustic state of the embodiment.
Figure 12B:
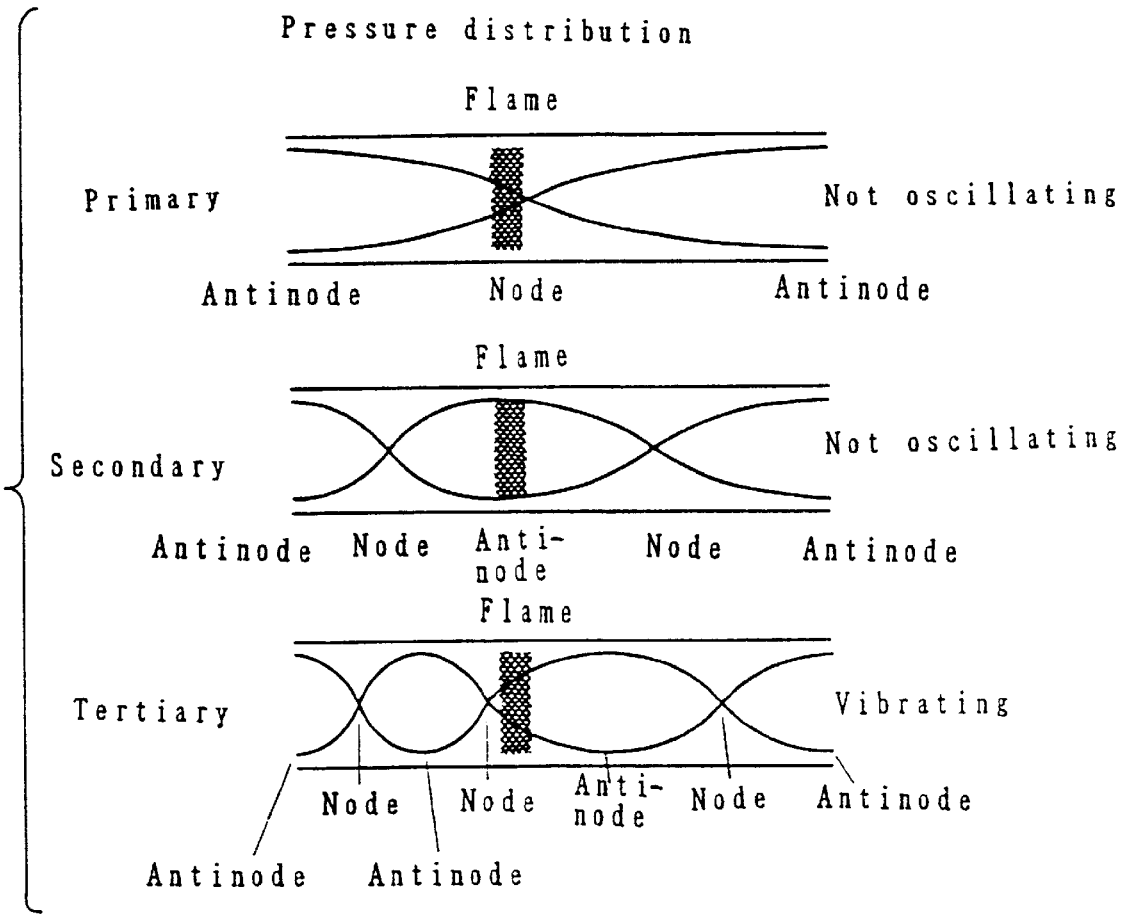

When the sound absorbing material is removed in FIG. 1, the structure is as shown in FIG. 2. The inside of the inlet buffer chamber 6 is a mere free space 301, and oscillatory combustion occurs at the same time. This oscillatory combustion is an oscillation formed by the acoustically closed ends at the inlet reflection surface 23 and outlet reflection surface 24 in the bottom of the inlet buffer chamber 6. When oscillatory combustion occurs, pressure fluctuations of a single frequency are detected in the combustion apparatus, and noise at the same frequency is detected outside the combustion chamber 9. In this case, the stationary wave is generated in the parts excluding the intake tube 1 and exhaust tube 5, and the oscillation frequency is relatively high as compared with the prior art of oscillating in the entire combustion apparatus. In this case, at the inlet reflection surface 23 and outlet reflection surface 24, maximum values of pressure are observed. FIG. 12 is a simple explanatory diagram for explaining the pressure situation. In the diagram, the blower is positioned in the inlet buffer chamber. Usually tertiary stationary waves are generated. At the overall length of 500 mm, the oscillation frequency is 760 Hz when the temperature of the combustion apparatus is low after ignition, and gradually elevates to 800 Hz when stabilized. The structure is complicated inside the combustion apparatus, and the acoustic length is larger than 500 mm. The oscillating tendency is invariable if the length of the intake tube 1 and exhaust tube 4 is changed from 50 cm to 10 m. Therefore, the length of the intake tube 1 and exhaust tube 5 is known to be indifferent to the oscillatory combustion.

Figure 13:
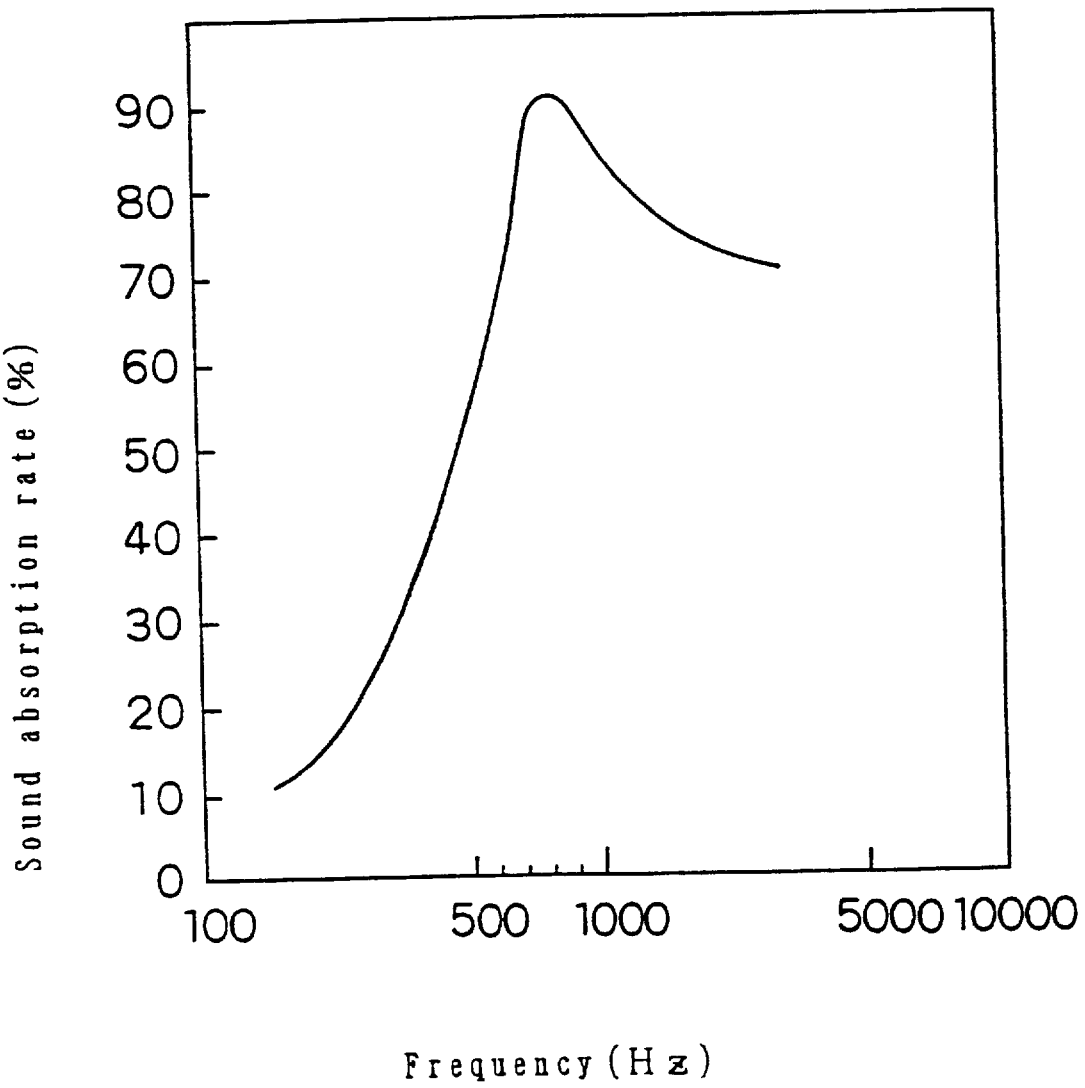
FIG. 13 is a diagram for showing the characteristic of sound absorbing material in the embodiment.

From the state in FIG. 2, when the inlet buffer chamber 6 is filled with sound absorbing material suited to the specific stationary wave mentioned above to compose again as shown in FIG. 1, oscillation does not occur. Besides, when the length of the intake tube 1 and exhaust tube 5 was changed from 50 cm to 10 m, oscillation did not occur. The following is known from this fact. When the premixed flame 21 is positioned between acoustically closed ends, the length of the intake tube 1 and exhaust tube 5 has no relation with the generating condition and oscillation frequency of oscillatory combustion. When this oscillation is prevented by sound absorbing material, oscillation does not occur if the length of the intake tube 1 and exhaust tube 5 is changed. Generally, the sound absorbing material is higher in effect when the sound absorbing and oscillation absorbing characteristics are higher in frequency, and therefore the generated oscillation is preferred to be as high as possible. In FIG. 12, therefore, the oscillating condition must be set at higher frequency as far as possible. FIG. 13 shows the sound absorbing characteristic of the specified sound absorbing material, and there is a peak of sound absorption near 800 Hz. Therefore, to absorb the oscillation effectively by this sound absorbing material, the stationary waves must be generated around 800 Hz.

Herein, the oscillating condition of oscillatory combustion is discovered by Rayleigh, and is defined as follows: oscillation occurs in a combustion apparatus when a flame is present at a position of ¼ wavelength acoustically.

This oscillating condition is formulated by Putnam, and the integral formula is expressed as follows:

$$1/\gamma \cdot \int p \cdot h dt > 0 \quad (1)$$

This integral form expresses integration of one cycle. In this formula, $\gamma$ is a specific heat ratio, p is pressure fluctuation, and h is heat fluctuation, $\omega$ is angular velocity, t is time, and $\theta$ is phase difference of p and h.

Solving the integral formula expressed in $$p=|p| \cos(\omega t),\ h=|h| \cos(\omega t-\theta) \quad (2)$$

yields $$\omega/(2\pi\gamma) \cdot |p|\ |h| \cos\theta > 0 \quad (3)$$

Therefore $$\cos\theta > 0 \quad (4)$$

(Collected Papers at 13th Research Meeting of Association of Energy and Resources, Apr. 18, 1994, p. 153). It shows that oscillation occurs when the phases of p and h are in the relation of $-\pi/2$ to $\pi/2$. That is, when oscillation or sound of oscillation frequency(sympathetic frequency) is given to the combustion apparatus, oscillatory combustion occurs when the position of the flame as seen from the flow direction is between node and antinode of oscillation or sound.

Figure 3A:
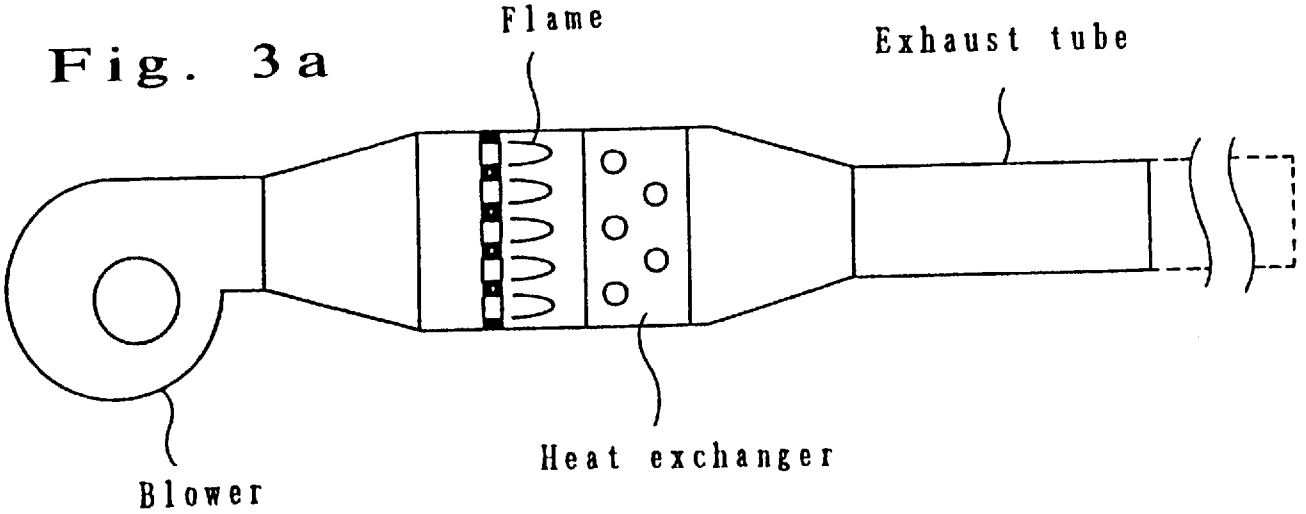
FIGS. 3*a* and 3*b* (referred to collectively as FIG. 3) are explanatory diagrams of onset status of oscillatory combustion.
Figure 3B:
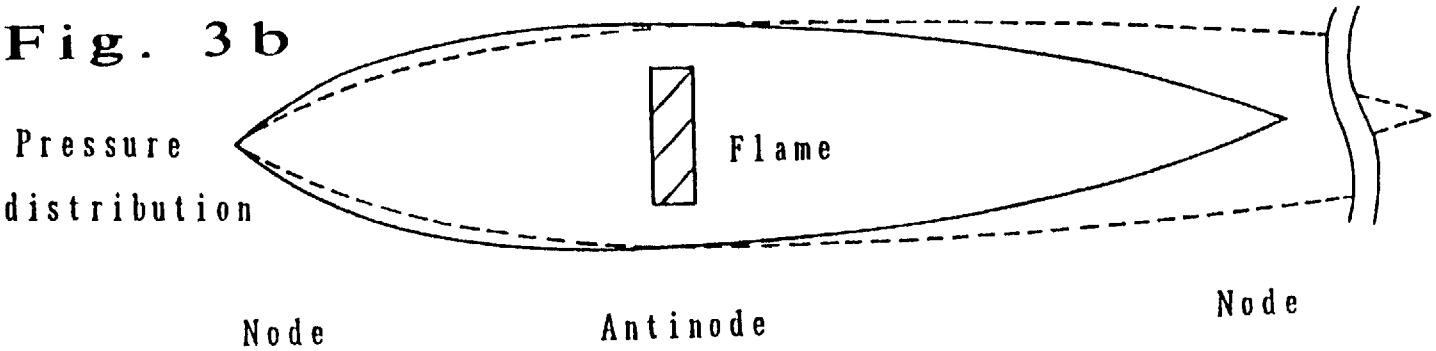

FIG. 3 is a diagram showing the oscillation situation in the basic mode in a conventional combustion apparatus, showing that both inlet and outlet ends are open. Oscillation occurs when the position of flame is at the upstream side of the antinode of pressure. In this case, the inlet and outlet of the combustion apparatus are the antinode of pressure. Vibration attenuates when the position of flame is moved to the downstream side of the antinode of pressure. Incidentally, when h is small, the integral formula may be sometimes positive, but oscillation does not occur because there is attenuation in the combustion apparatus. In this way, hitherto, to prevent oscillation, the phase of h and p was adjusted so that the integral formula may be 0 or negative. Or, in order to minimize h, low load combustion has been attempted. In actual combustion apparatus, since there is attenuation of oscillation in the combustion apparatus, when h is slightly larger than 0, it may be handled as 0.

In such acoustically open combustion apparatus, when the exhaust tube is extended as indicated by broken line, the frequency is lowered, and the pressure peak moves to the exhaust tube side, and hence oscillation is likely to occur. Therefore, in the acoustically open combustion apparatus as in the prior art, when the value of h is large, the oscillation condition is established when the intake tube is shortened or exhaust tube is extended. Thus, in the acoustically open combustion apparatus, it is know that the length of intake tube or exhaust tube has a large effect on onset of oscillatory combustion. In high load combustion, because of large h, oscillation is more likely to occur.

In the embodiment, on the other hand, when acoustic closed ends re formed before and after the premixed flame 21 as shown in FIG. 1, oscillatory combustion occurs in which the closed end is the peak of pressure, and the oscillation frequency is determined by the dimension between the closed ends and the state of the flame 19. In FIG. 1, the length of intake tube 1 and exhaust tube 5 is variable, but regardless of the length of intake tube 1 and exhaust tube 5, the oscillation frequency is invariable. Therefore, when the oscillation is suppressed at the inlet buffer chamber 6 as shown in FIG. 1, oscillation does not occur if the length of intake tube 1 or exhaust tube 5 is varied.

(Embodiment 2)

Other embodiment of the invention is described below while referring to FIG. 4.

Figure 4:
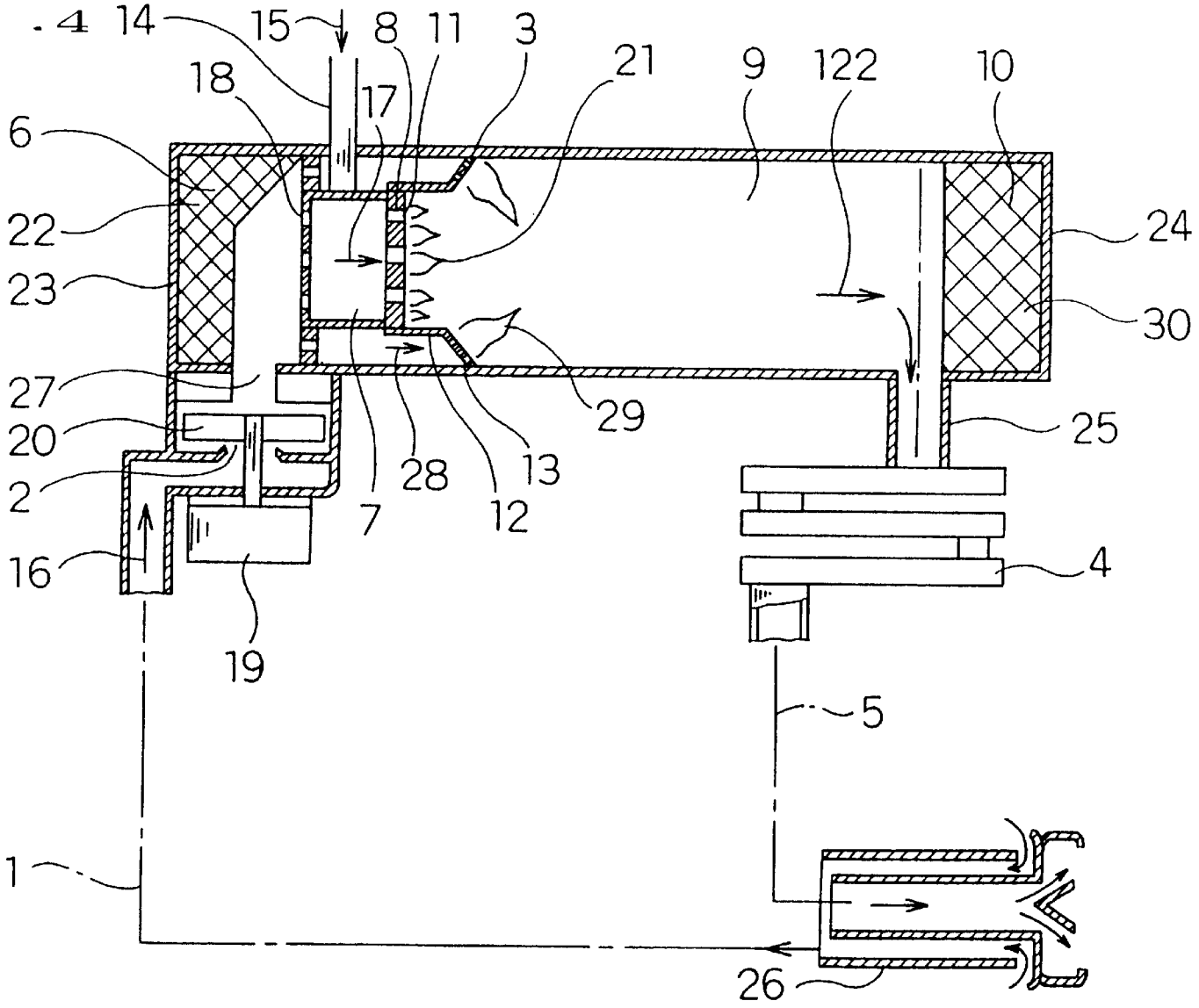
FIG. 4 is a sectional view of other embodiment of the invention.

In FIG. 4, an outlet sound absorbing unit 30 filled with sound absorbing material is provided in the outlet buffer chamber 10. Vibration is attenuated in both inlet buffer chamber 6 and outlet buffer chamber 10, and hence the attenuation effect of oscillation is notable. Vibratory combustion increases in frequency from ignition until combustion is stabilized. The sound absorbing material differs in the sound absorbing characteristic depending on its variety. Therefore, when the grade of the sound absorbing material in the inlet buffer chamber 6 and outlet buffer chamber 10 is varied to different types corresponding to plural frequencies of the oscillatory combustion, an appropriate sound absorbing effect is obtained.

(Embodiment 3)

A different embodiment of the invention is described below while referring to FIG. 5.

Figure 5:
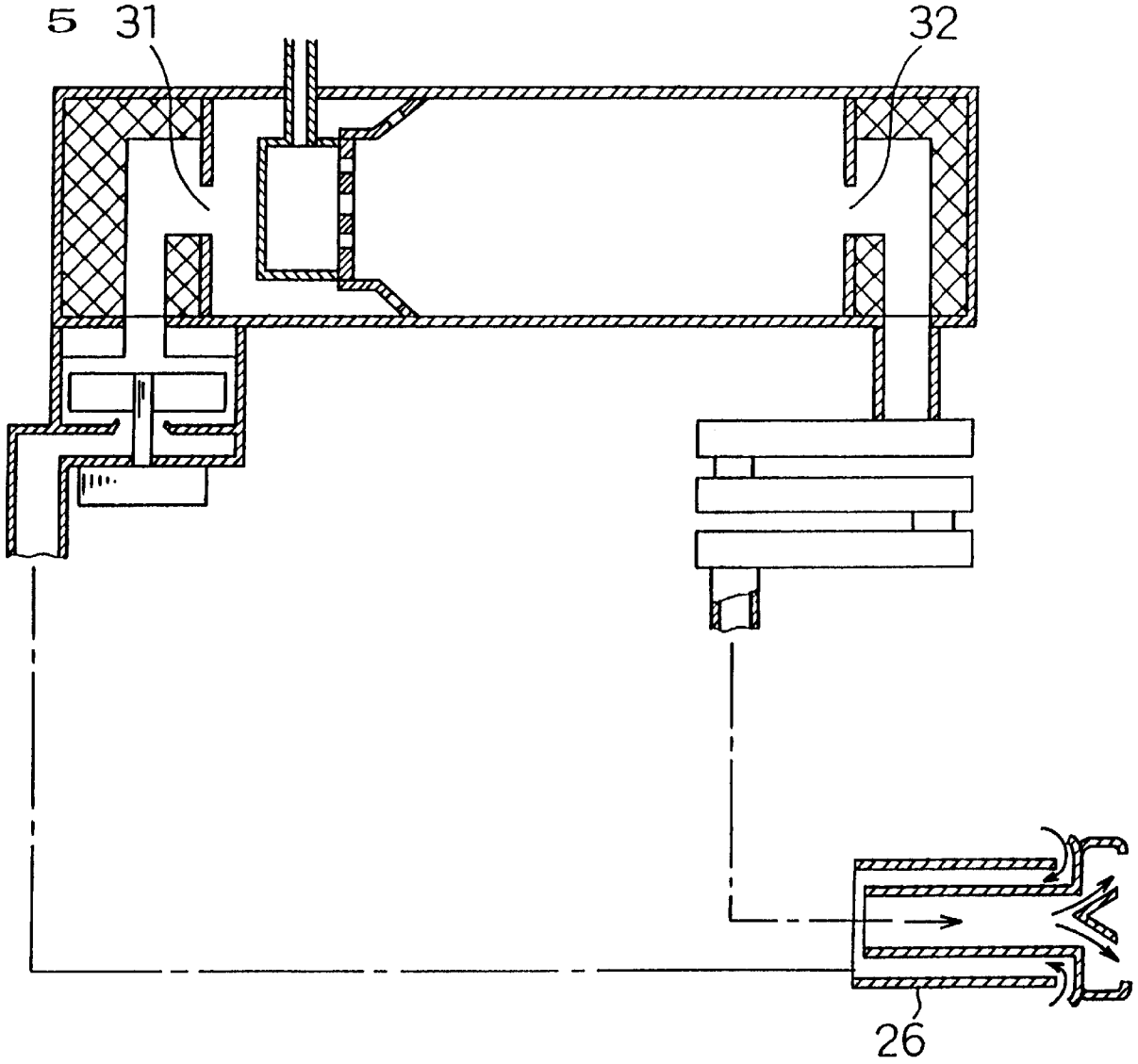
FIG. 5 is a sectional view of a different embodiment of the invention.

In FIG. 5, an inlet throttle 31 is provided at the burner port 11 side of the inlet buffer chamber 6. By this throttle 31, the oscillations are in phase inside the inlet buffer chamber 6, and the pressure is at the antinode on the entire wall of the inlet buffer chamber 6. Therefore, when the entire inlet buffer chamber 6 is filled with sound absorbing material, the oscillation suppressing effect is outstanding. Moreover, when the oscillation passes through the throttle of this narrow section, it attenuates, and the oscillation suppressing effect is notable. Besides, when an outlet throttle 32 is provided at the inlet of the outlet buffer chamber 10, the pressure fluctuations in the outlet buffer chamber 10 are in phase, and the oscillatory combustion suppressing effect is greater.

(Embodiment 4)

Another different embodiment of the invention is described below while referring to FIG. 6.

Figure 6:
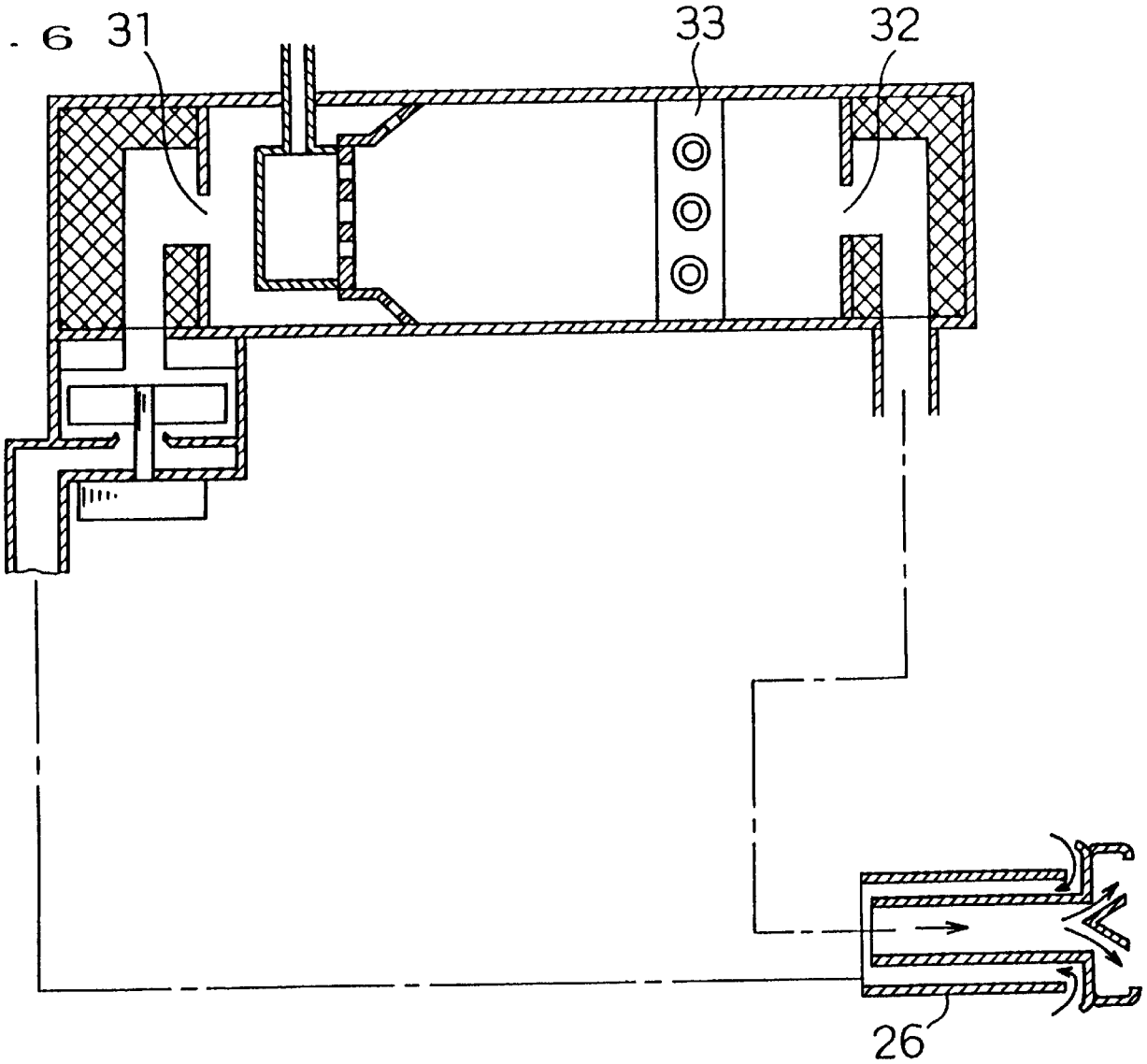
FIG. 6 is a sectional view of a further different embodiment of the invention.

In FIG. 6, a heat exchanger 33 is interposed between the burner port unit 8 and outlet reflection surface. Heat exchanged combustion gas 12 is at low temperature, and hence a low temperature material may be used for the sound absorbing material in the outlet buffer chamber 10.

(Embodiment 5)

An embodiment of other aspect of the invention is described below while referring to FIG. 7.

Figure 7:
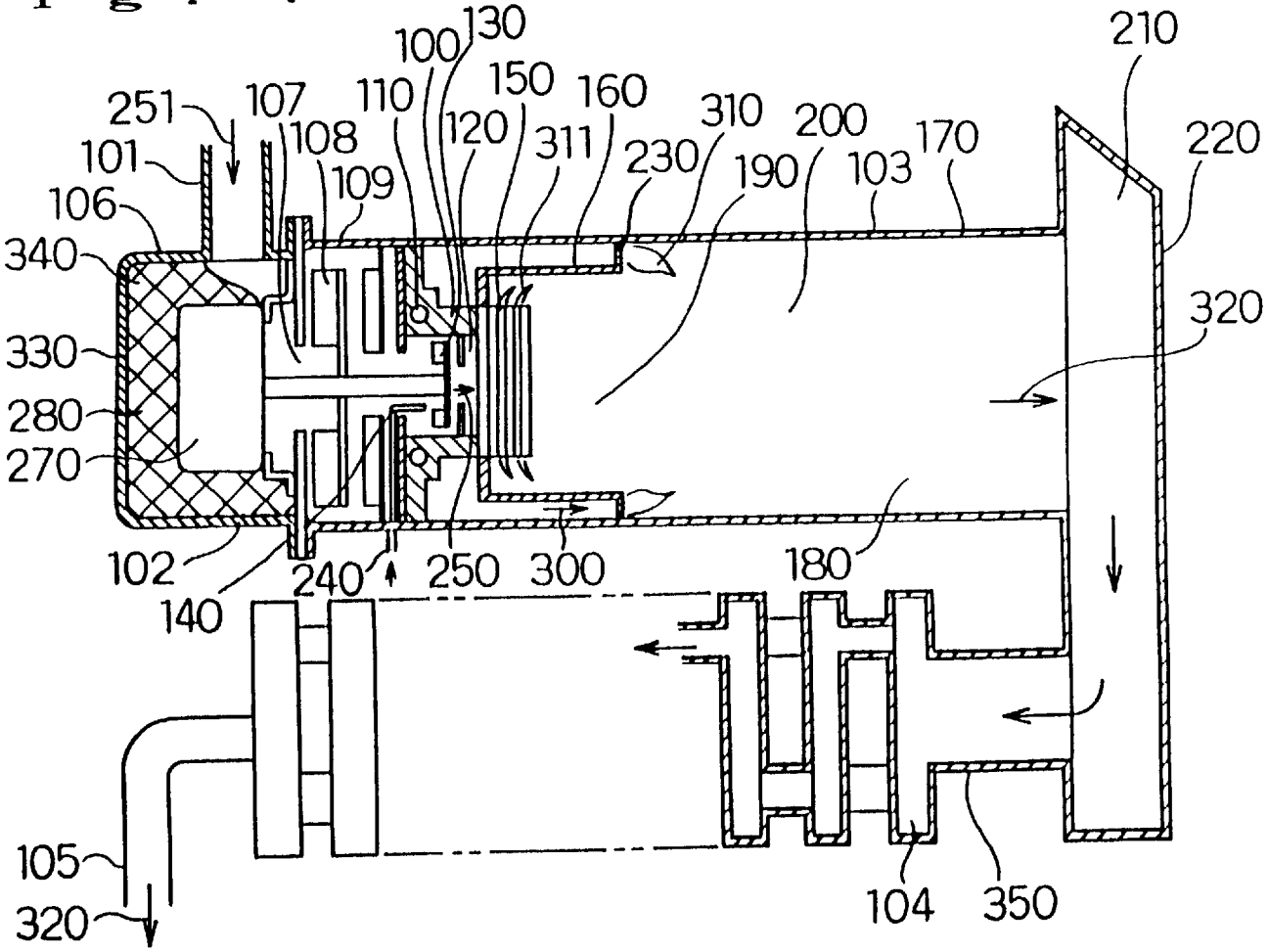
FIG. 7 is a sectional view of an embodiment of other aspect of the invention.

FIG. 7 is a sectional detail view of an embodiment of a combustion apparatus in other aspect of the invention. The combustion apparatus comprises an intake tube 101, a blower unit 102, a combustion section, 103, a heat exchanger 104, and an exhaust tube 105. The blower 102 comprises a motor case 106, a throttle 107, a fan 108, a fan case 109, and an vaporizing tube 100. A heater 110 is built in the vaporizing tube 100, and the inside of the vaporizing tube 100 is used as a mixing chamber 120, and a rotary 130 and a fuel supply path 140 are built in the mixing chamber 120. The vaporizing tube 100 using the rotary 130 is small in flow resistance, and the capacity of the fan 108 may be smaller, so that the noise is low. Acoustically, the resistance is small.

The combustion section 103 comprises a burner port unit 140, a combustion plate 160, and a combustion tube 170. A combustion chamber 180 consists of a primary combustion chamber 190 and a second combustion chamber 200, and the burner port unit 140 and combustion plate 160 form the primary combustion chamber 190, and the combustion tube 170 forms the secondary combustion chamber 200. A return header 210 is coupled to the combustion section 103. Part of the wall of the return header 210 faces the combustion chamber 180, and forms an outlet reflection surface 220.

Multiple burner ports are pierced in the burner port unit 150, and the combustion plate 160 is placed in the circumference, and secondary air vents 230 are provided. In the downstream part of the combustion plate 160, the combustion chamber 180 and return header 210 are installed. In the mixing chamber 120, the fuel supply path 140 is connected, from which a liquid fuel 140 is supplied into the mixing chamber 120, and pulverized by the rotary 130, and collides against the wall of vaporizing tube 100 to be vaporized, and the fuel 240 and combustion air 251 are mixed in the mixing chamber 120, and a premixed gas 250 is prepared.

The burner port unit 150 projects into the primary combustion chamber 190. By decreasing the area of burner ports, when noise or oscillation is given from outside the combustion apparatus, it is the antinode of oscillation in the combustion plate 160, and therefore since the flame is projecting from the combustion plate 160, it is positioned acoustically between the antinode and node.

In the blower 102, the combustion air 251 is inhaled from the intake tube 102 by the fan 108 driven by a motor 270, and passes through the inlet buffer chamber 280 to be mixed with the fuel in the mixing chamber 120. The premixed gas 250 flows into the combustion chamber 180 through burner ports, and ignited, and a premixed flame 311 is formed in the primary combustion chamber 190. At the downstream side of the combustion plate 160, multiple secondary air vents 230 are pierced, and secondary air 300 is supplied through the secondary air vents 160, and a diffusing and burning secondary flame 310 is formed. After complete combustion in the secondary combustion chamber 200, the combustion gas 320 passes through the return header 210 and communication tube 350, and flows into the heat exchanger 104.

The combustion gas 320 heated to high temperature is partly heat exchanged through the wall of the combustion chamber 180, and then heat exchanged while passing through the return header 210 and heat exchanger 104 to be lowered in temperature, and release to the atmosphere from the exhaust tube 105 through the intake-exhaust tube.

The bottom of the inlet buffer chamber 280 is an inlet reflection surface 330. An inlet sound absorbing unit 340 made of sound absorbing material is provided in the inlet buffer chamber 280. The inlet of the inlet buffer chamber 280 and the output of the return header 210 are nearly vertical to the inlet reflection surface 330 and outlet reflection surface 220, and their sectional area should be as small as possible. The combustion chamber 180 and heat exchanger 104 are connected through the return head 210 and communication tube 350. To form a closed end at the outlet reflection surface 220 acoustically, the sectional area of the return head 210 should be as small as possible. If too small, however, the flow resistance of the combustion gas 320 increases, and the noise is increased in order to raise the capacity of the blower 102. Therefore, the sectional area of the return head 210 must be maintained so as to satisfy the closed end.

The inlet buffer chamber 280 and fan 108 are connected through the throttle 107. The intake tube 101 is connected to the inlet of the inlet buffer chamber 180, and the intake tube 101 is variable in length. An inlet sound absorbing unit 340 made of sound absorbing material is provided in the inlet buffer chamber 280. The intake tube 101 is positioned nearly vertically to the inlet buffer chamber 280.

Figure 8:
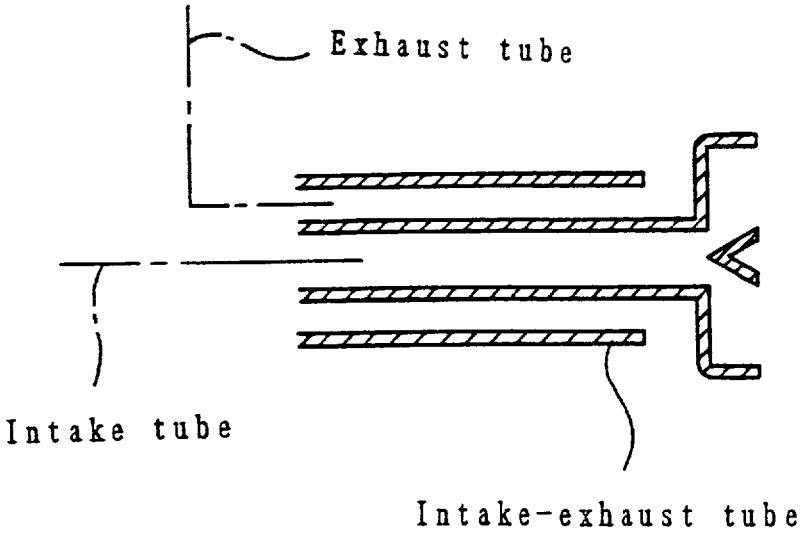
FIG. 8 is a partial sectional view of the embodiment.

FIG. 8 shows the structure of intake-exhaust tube. As shown in FIG. 7, the exhaust tube 105 is connected to the outlet of the heat exchanger 104, and the intake-exhaust tube in FIG. 8 is connected to one outlet of the exhaust tube 105. The intake-exhaust tube is coaxial so that the outside may be the intake tube 101 and inside the exhaust tube 105, and low temperature combustion air flows outside, and high temperature combustion gas 320 flows inside. In this case, the intake tube 101 and exhaust tube 105 are adjustable in length, and their front ends are acoustically open ends. In the combustion apparatus of such constitution, oscillation does not occur regardless of the length of the intake tube 101 or exhaust tube 105.

Figure 9:
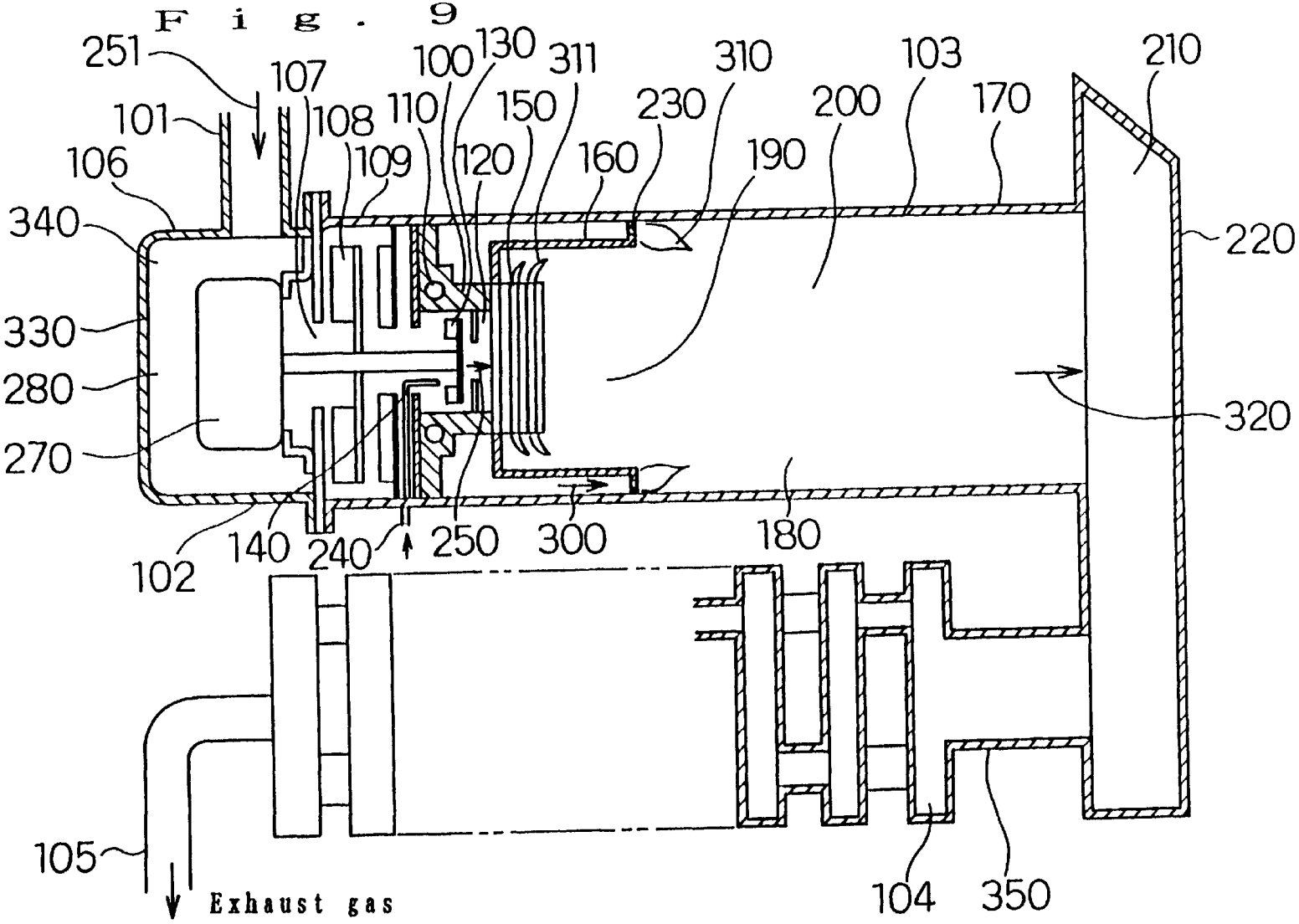
FIG. 9 is an explanatory sectional view of the embodiment.
Figure 10:
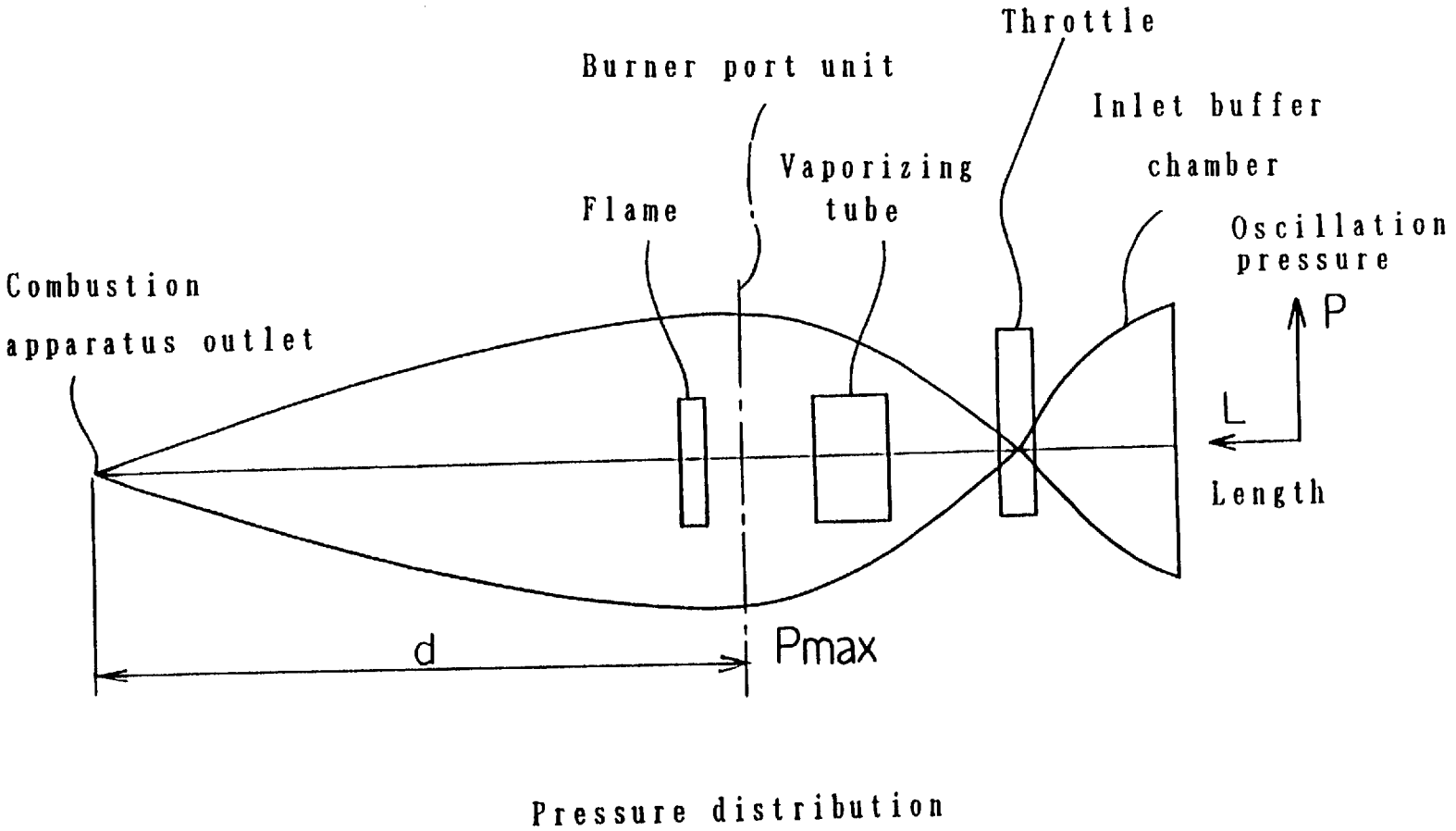
FIG. 10 is a diagram of a mode for explaining the acoustic state of the embodiment in FIG. 15.
Figure 11:
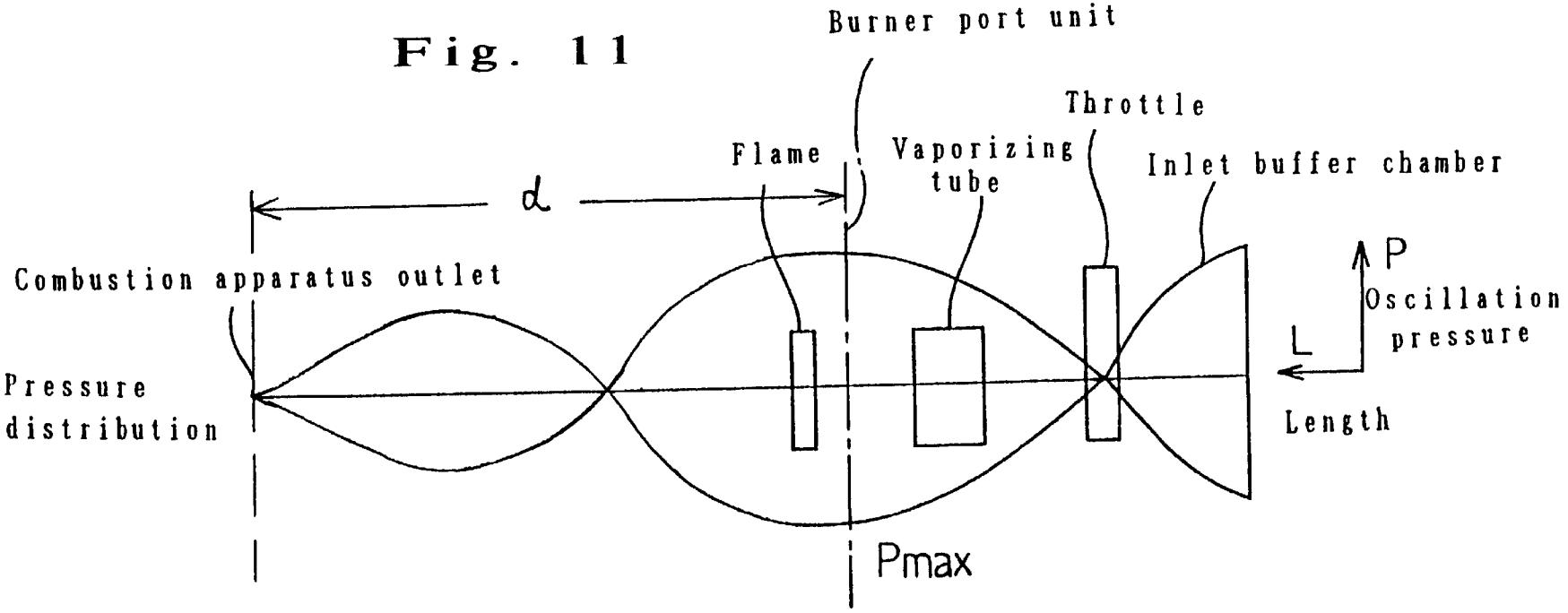
FIG. 11 is a diagram of other mode for explaining the acoustic state of the embodiment in FIG. 15.
Figure 15:
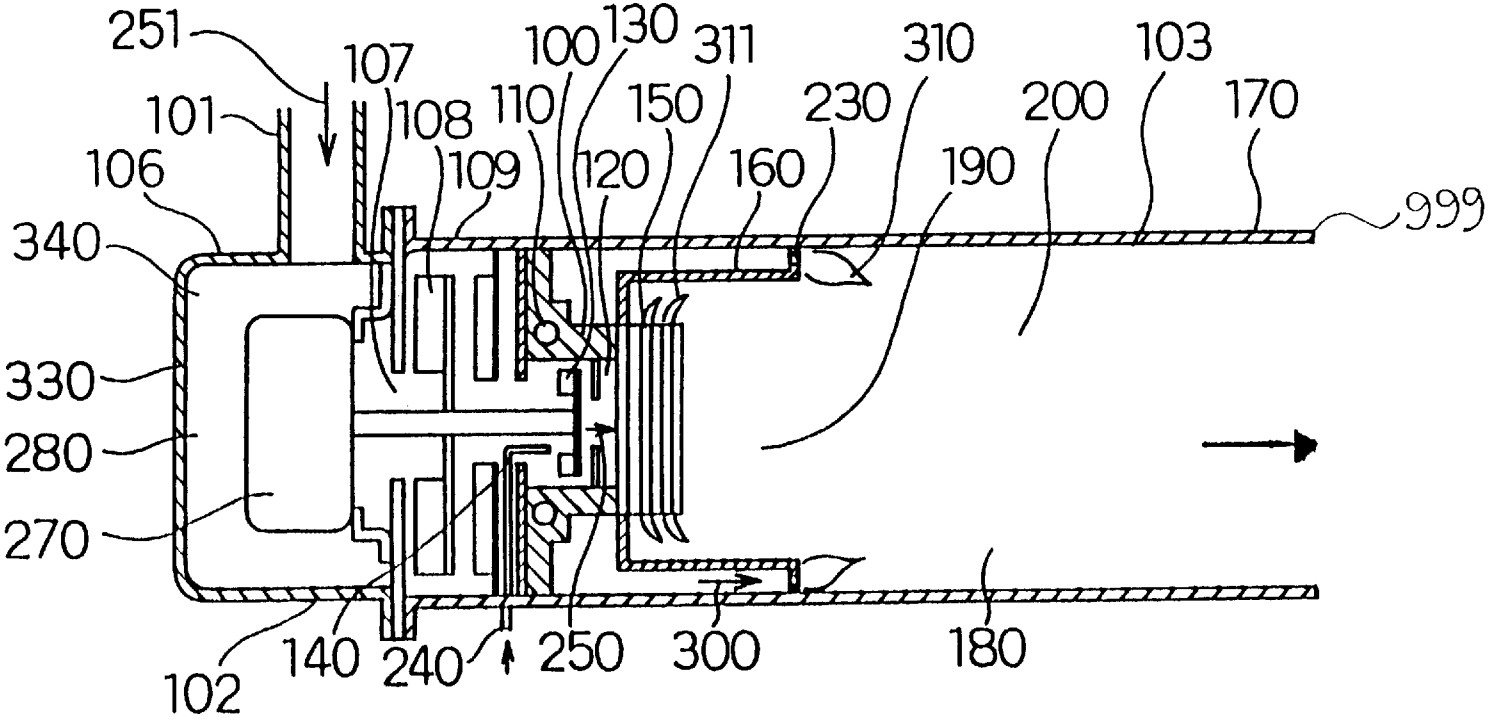
FIG. 15 is a diagram for explaining another embodiment of the invention.

FIG. 9 is a structural diagram realized by removing the sound absorbing material in FIG. 7 as described later. Besides, FIG. 15 is a diagram showing the case of opening the outlet reflection surface 220 in FIG. 9. FIGS. 10 and 11 are schematic expression of acoustic characteristic in the structure in FIG. 15. That is, when sound or oscillation at oscillation frequency is given from outside, it becomes the antinode of oscillation at the combustion plate. Since the flame is positioned at the downstream side of the antinode of pressure, oscillation does not occur. The throttle is the node and the entire buffer chamber is the antinode of pressure.

Therefore, as shown in FIG. 15, if the outlet reflection surface 220 is not present and the place is kept open, the invention provides a constitution of a combustion apparatus comprising a combustion section composed of a combustion chamber and a burner port unit, a blower for supplying combustion air into the combustion section, a motor case incorporating a motor, being provided in the blower, a fan case incorporating a fan, being provided in the blower, a vaporizing tube incorporating a rotary provided between the motor and burner port unit, an inlet buffer chamber provided between the motor case and motor, and a throttle provided between the motor case and fan, wherein the combustion chamber consists of a combustion plate having secondary air vents for forming a primary combustion chamber and a combustion tube for forming a secondary combustion chamber, the burner port unit projects into the primary combustion chamber, the outlet of the combustion tube is open, and the ratio of the acoustic length from the burner port unit to the upstream side (inlet reflection plate) and the acoustic length from the burner port unit to the downstream side (combustion chamber open outlet 999) is set at a specific ratio capable of preventing oscillation; or comprising a combustion section composed of a combustion chamber and a burner port unit, a blower for supplying combustion air into the combustion section, a motor case incorporating a motor, being provided in the blower, a fan case incorporating a fan, being provided in the blower, a vaporizing tube incorporating a rotary provided between the motor and burner port unit, an inlet buffer chamber provided between the motor case and motor, a sound absorbing unit filled with a sound absorbing material, being provided in the inlet buffer chamber, and a throttle provided between the motor case and fan, wherein the burner port unit has multiple burner ports provided in the side wall of the burner port shape, the combustion chamber consists of a combustion plate having secondary air vents for forming a primary combustion chamber and a combustion tube for forming a secondary combustion chamber, the outlet of the combustion tube is open, and the ratio of the acoustic length from the burner port unit to the upstream side (inlet reflection plate) and the acoustic length from the burner port unit to the downstream side (combustion chamber open outlet) is set at a specific ratio capable of preventing oscillation, so that the oscillation can be prevented. The length of the open combustion chamber and others should be set to proper length. That is, oscillation can be prevented by properly setting the ratio of the acoustic length from the burner port unit 150 to the upstream side (inlet reflection plate 330) and the acoustic length from the burner port unit 150 to the downstream side (combustion chamber open outlet 999).

A practical example is described below. In the actual combustion apparatus, the size of the motor and others installed from the burner port unit to the inlet reflection plate is approximately determined, and hence the distance from the burner port unit to the outlet should be defined appropriately. Supposing the number of modes to be n, the wavelength of oscillation to be λ, and the distance from the combustion apparatus outlet 999 to burner port unit 150 to be d, the condition for not inducing oscillation is expressed as follows.

$$\{2(n-1)/4\}\times\lambda<d<\{(2N-1)/4\}\times\lambda \quad (5)$$

When n=1, as clear from FIG. 10, it follows that $0<d<\lambda/4$. When n=2, as shown in FIG. 11, it follows that $\lambda/2<d<(3/4)\cdot\lambda$.

Incidentally, the distance d to the reflection surface or outlet may be based on the combustion plate. That is, the both may be handled equivalently.

When the sound absorbing material is removed in FIG. 7, the structure becomes as shown in FIG. 9. The inside of the inlet buffer chamber 280 is a mere free space, and oscillatory combustion occurs when burning. Vibratory combustion is a oscillation which takes place when the inlet reflection plate 330 and outlet reflection plate 220 in the bottom of the inlet buffer chamber 280 are acoustically closed ends. Once oscillatory combustion occurs, pressure fluctuations of a single frequency are detected in the combustion apparatus, while noise at the same frequency is sensed outside the combustion chamber 180. In this case, stationary waves are generated in the parts excluding the intake tube 101 and exhaust tube 105, and therefore the oscillation frequency is higher than in the oscillation of the entire combustion apparatus as in the prior art, and oscillations of relatively high frequency occur. In this case, maximum values of pressure are observed on the inlet reflection surface 330 and outlet reflection surface 220. At the overall length of 500 mm, the oscillation frequency is 770 Hz when the temperature of the combustion apparatus is low after ignition, and gradually climbs up to 810 Hz when stabilized. Since the structure is complicated inside the combustion apparatus, the acoustic length is larger than 500 mm. This oscillating tendency is not changed if the length of the intake tube 101 and exhaust tube 105 is changed from 50 cm to 10 m. Therefore, it is known that the length of intake tube 101 and exhaust tube 105 has no relation with the oscillatory combustion.

From the state in FIG. 9, when the inlet buffer chamber 280 is filled with sound absorbing material, and the structure is formed again as shown in FIG. 7, oscillation does not occur. When the length of the intake tube 101 and exhaust tube 105 was changed from 50 cm to 10 m, oscillation did not occur. The following is known from this fact. When the premixed flame 290 is positioned between acoustically closed ends, the length of intake tube 101 and exhaust tube 105 has no relation with the oscillatory combustion. When this oscillation is prevented by sound absorption, oscillation does not occur if the length of the intake tube 101 or exhaust tube 105 is changed.

That is, when acoustic closed ends are formed before and after the premixed flame 311 as shown in FIG. 7, oscillatory combustion occurs having the pressure peaks at the closed ends, and the oscillation frequency is determined by the distance between the closed ends and the state of flame. In FIG. 7, the length of the intake tube 101 and exhaust tube 105 is variable, but the oscillation frequency does not change regardless of the length of intake tube 101 and exhausts tube 105. Therefore, absorbing the oscillation in the inlet buffer chamber 280, when the generation of oscillation is suppressed, oscillation does not occur if the length of the intake tube 101 and exhaust tube 105 is changed. Generally, the sound absorbing material is large in sound absorbing and oscillation absorbing effect when the frequency is higher, and the generated frequency should be as far as possible.

In FIG. 7, an inlet throttle 107 is provided at the burner port side of the inlet buffer chamber 280. By this throttle 107, the oscillation in the inlet buffer chamber 280 is in phase and the pressure is at the antinode on the entire wall. Therefore, when the inlet buffer chamber 280 is entirely filled with sound absorbing material, the oscillation suppressing effect is very large. Besides, when the oscillation passes through this throttle 107 of narrow section, it is attenuated, and the oscillation suppressing effect is superior.

Figure 14:
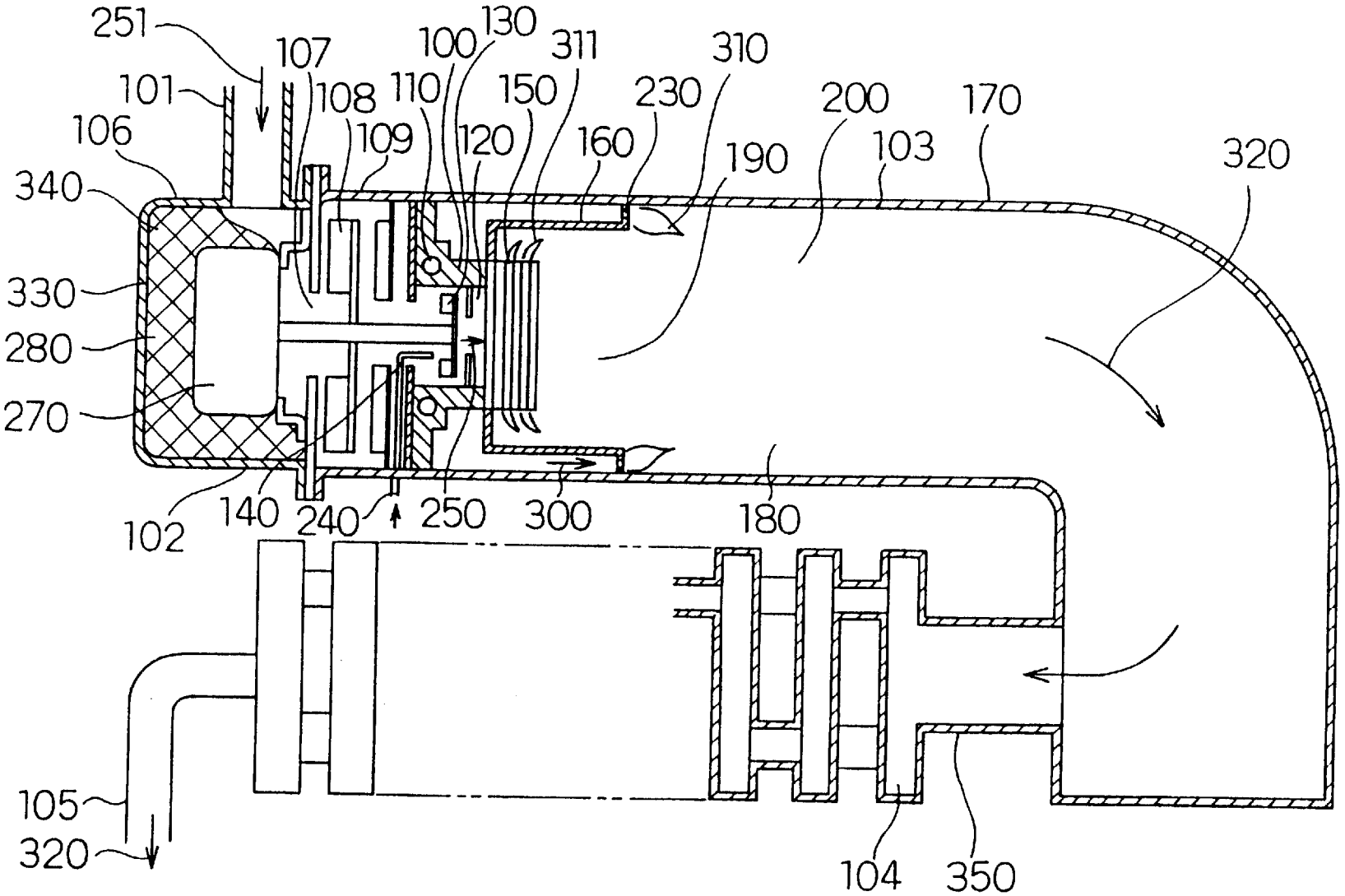
FIG. 14 is a diagram for explaining other embodiment of the invention.

Also in FIG. 7, instead of vaporizing the liquid fuel 240 in the mixing chamber 120 and mixing with combustion air to prepare premixed gas, a gas fuel may be used. In this case, without rotary 130, the gas fuel and combustion air are easily mixed and a uniform premixed gas is obtained. Or, as shown in FIG. 14, the combustion tube 170 may be bent round.

The reflection surface for generating acoustic region is not a mere plate as understood from the description of the embodiment above, and it may be called a reflection surface including a buffer chamber.

The above explanation has a marked effect when the structure of the combustion apparatus is acoustically one-dimensional.

In the embodiment, in the case of type closed at both ends, as shown in the drawing, it is preferred that the shape of the structures disposed between the reflectors and on the central axis of the combustion section (the central axis of the combustion section equivalent to a cylindrical shape) be axis symmetrical to the central axis.

Also in the embodiment, in the type of the open outlet side, it is preferred that the shape of structures disposed between the combustion tube outlet and reflector and on the central axis of the combustion section be axis symmetrical to the central axis.

As clear from the description herein, in the invention in which acoustically closed ends are formed before and after the flame, the intake tube or exhaust tube is connected to the closed ends, and the buffer chamber is disposed at the closed end before the flame, therefore, generation of oscillatory combustion may be suppressed if the intake tube or exhaust tube is extended.

Besides, when a buffer chamber is disposed at each closed end, a closed end is easily formed.

When a throttle is provided at the flame end of the buffer chamber, the pressure in the buffer chamber becomes constant, and the pressure reaches the maximum value, so that the silencing effect is great.

When a buffer chamber is installed at the closed end behind the flame, the inhibitory effect of oscillatory combustion is great.

By installing a heat exchanger between the flame and closed end, it is greatly effectively on heat resistance of the sound absorbing material in the rear part.

When one end of the intake tube and exhaust tube is opened, there is no acoustic effect on the closed end system before and after the flame, and hence the oscillation suppressing effect is notable.

Generation of oscillatory combustion can be also suppressed by forming an acoustic closed end at the upstream side of the flame, and installing a buffer chamber at the upstream side of the flame to form an acoustic closed end.

Or if one end is an open end, oscillatory combustion can be suppressed by properly defining the relation between the distance from the burner port unit to the open end and the distance to the closed end.

Further embodiments of the other aspect of the invention are described below while referring to the accompanying drawings.

In the next description, different from the foregoing embodiments, a sound absorbing mechanism of Helmholtz type or the like is used as the sound absorbing means. Those basically same as in FIG. 29 are identified with same reference numerals, and their explanations are omitted.

(Embodiment 6)

Figure 16B:
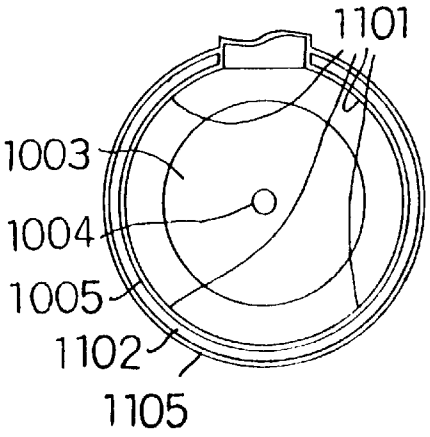
FIGS. 16 *a* and 16*b* (referred to collectively as FIG. 16) are structural diagrams of a combustion apparatus of FF type space heater in an embodiment of the invention.
Figure 16A:
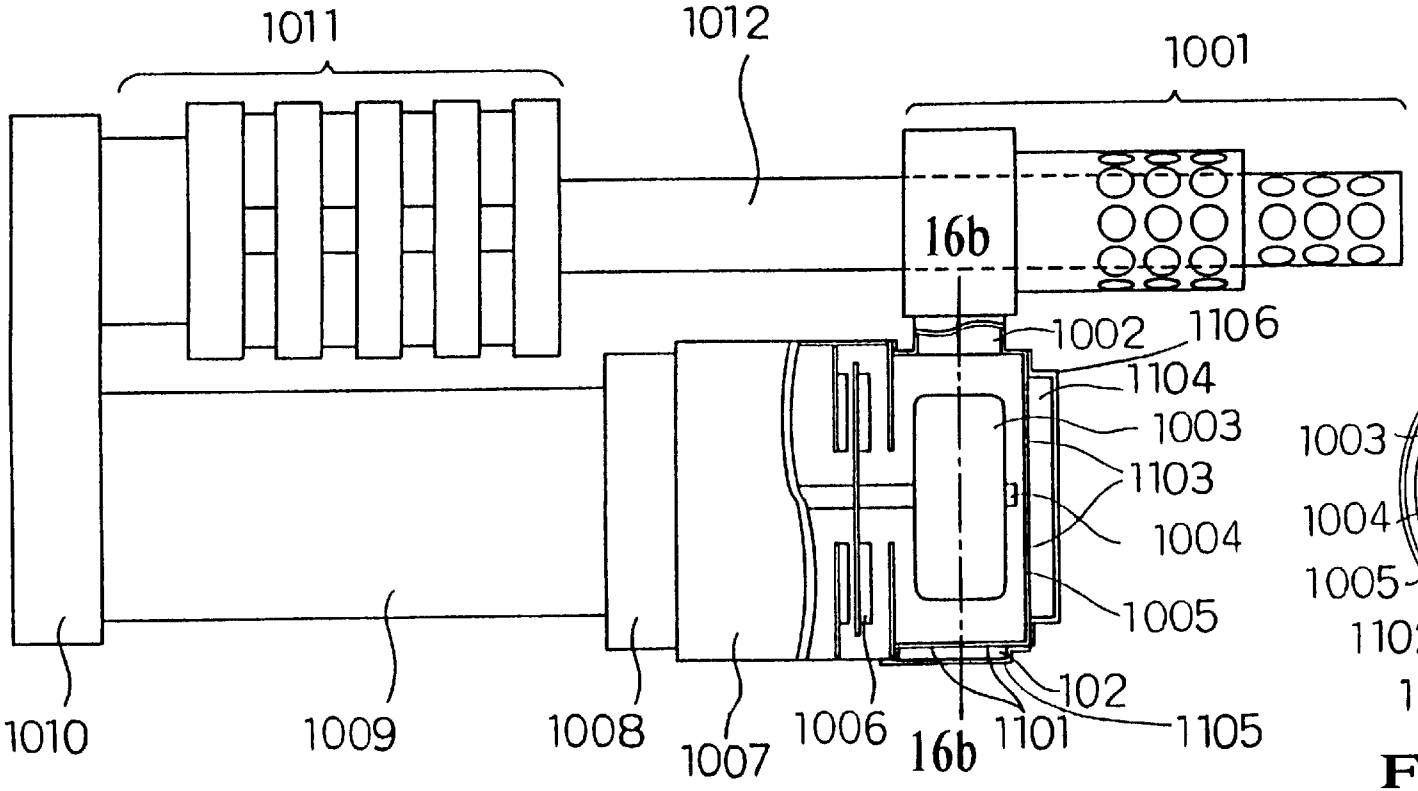

FIG. 16 is a structural diagram of a combustion apparatus of an FF type space heater in an embodiment of the other aspect of the invention.

Figure 29B:
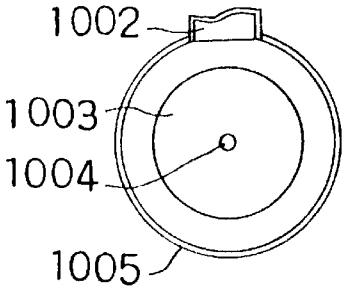
Fig. 29b PRIOR ART
FIGS. 29*a* and 29*b* (referred to collectively as FIG. 29) are structural diagrams of a combustion apparatus of a conventional FF type space heater.
Figure 29A:
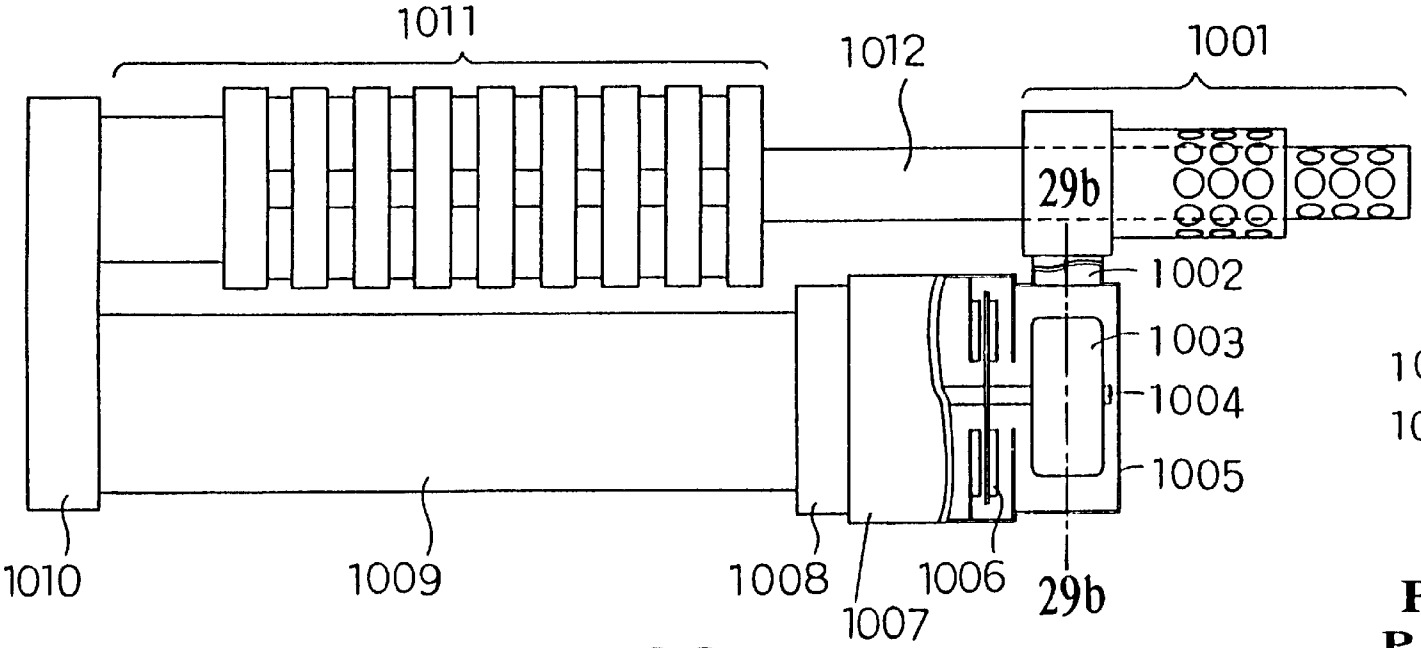
Fig. 29a PRIOR ART

A principal difference of the embodiment from FIG. 29 is, as shown in FIG. 16, that a hole is opened in the motor case in order to prevent oscillatory combustion, and that a closed space is provided further outside by using space forming members 1105, 1106. In such constitution, a sound absorbing device of Helmholtz type is formed, pressure fluctuations are absorbed, and oscillatory combustion is prevented.

Referring to FIG. 16, the constitution and operation of the embodiment are explained specifically below, mainly relating to the difference.

Pressure waves generated by the flame in the burner 8 as mentioned above progress along the motor shaft 4. The pressure waves are changed in the running direction by the motor 3, and collide against the motor case 5. Consequently, the motor case 5 becomes a closed end of acoustic element, where reflection occurs.

Therefore, pressure fluctuations in this area are large. A great effect is expected when a Helmholtz sound absorbing device is installed in this area.

Accordingly, as shown in FIG. 16, an openings 1101 and an opening c 1103 are provided in this area, and space forming members are installed so as to cover each opening and form a specified space.

More specifically, as for the opening a 1101, a space forming member a 1105 nearly in a ring shape having a hole corresponding to the contour of the intake tube 2 is provided in the portion joining with the intake tube 2 so as to surround the outer circumference of the motor case 5, and as for the opening c 1103, a space forming member b 1106 nearly in a circular dish shape having a flange is provided at the outside end portion of the motor case 5.

By these space forming members 1105, 1106, a closed space b 1102 and a closed space d 1104 are formed on the outside of the motor case 5. The opening a 1101 and opening c 1103 may not be always circular. The air intake means of the invention includes motor 3 and fan 6, among others, and the coupling means of the invention corresponds to the return head 1010.

In this way, a Helmholtz sound absorbing device is formed between the opening and closed space, and supposing the volume of the closed space b 1102 to be Vb, the volume of the closed space d 1104 to be Vd, the total area of the holes of the opening a 1101 to be Sa, the total area of the holes of the opening c 1103 to be Sc, the plate thickness of the motor case 5 in the opening a 1101 to be ta, the plate thickness of the motor case 5 in the opening c 1103 to be tc, the equivalent diameter assuming one hole of the opening a 1101 to be circular to be da, and the equivalent diameter assuming one hole of the opening c 1103 to be circular to e dc, the sound absorbing effect is exhibited at the following frequencies fa, fc, where Cair is the sonic speed in air.

$$fa = (Cair/(2\pi))\sqrt{(Sa/(Va \cdot la))}\ , \text{where } la = ta + 0.8da$$

$$fc = (Cair/(2\pi))\sqrt{(Sc/(Vc \cdot lc))}\ , \text{where } lc = tc + 0.8dc$$

Therefore, by setting the volumes Vb, Vd, and areas Sa, Sc, and others so that fa and fc may coincide with the frequency of the oscillatory combustion occurring without installation of Helmholtz sound absorbing device, pressure fluctuations at the same frequencies are absorbed, and the oscillatory combustion can be prevented.

(Embodiment 7)

Figure 17B:
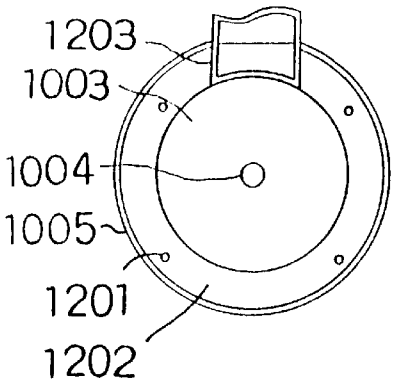
FIGS. 17*a* and 17*b* (referred to collectively as FIG. 17) are structural diagrams of a combustion apparatus of FF type space heater in other embodument of the invention .
Figure 17A:
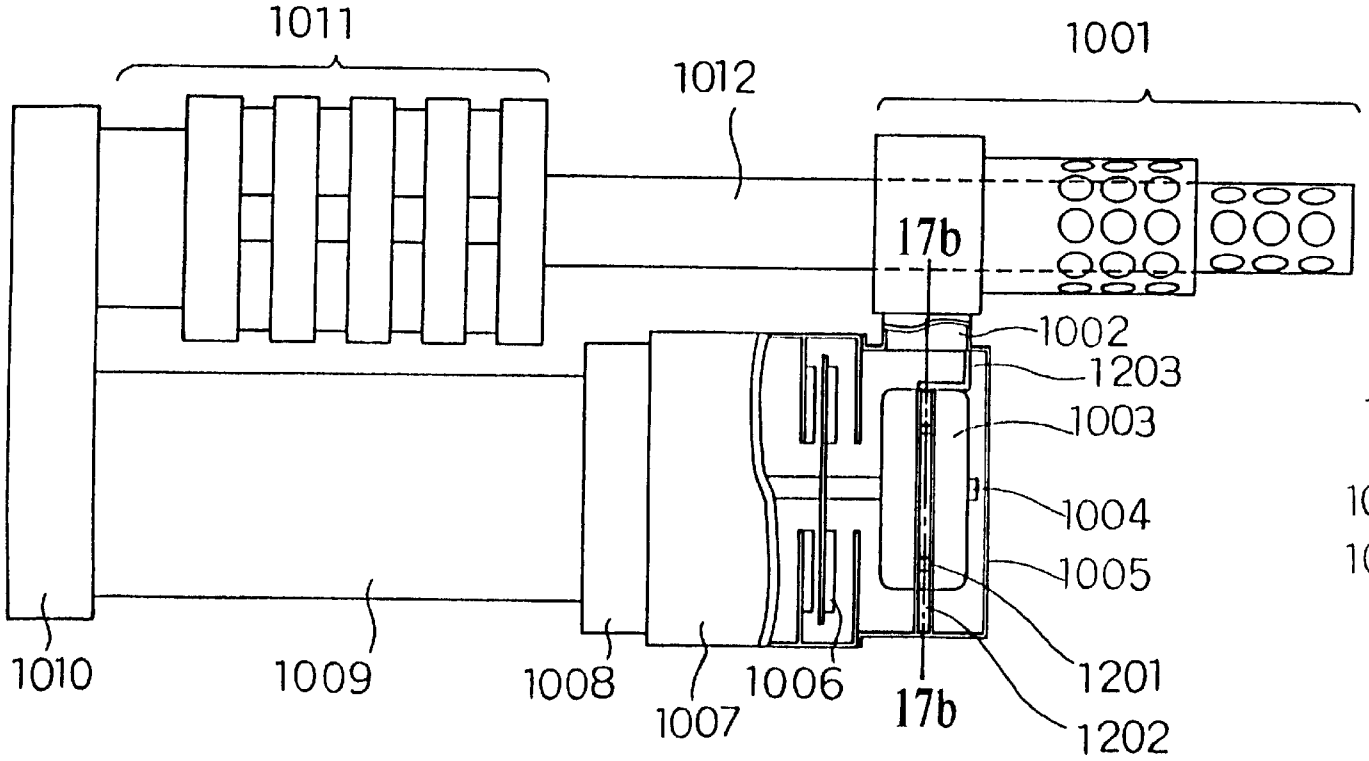

FIG. 17 is a structural diagram of a combustion apparatus of an FF type space heater in a different embodiment of the other aspect of the invention.

A principal difference of the embodiment from FIG. 29 is as follows: to prevent oscillatory combustion, a plate for coupling the intake port of combustion air and motor side surface is installed nearly parallel to the direction of air flowing through the intake port of combustion air to define the flow so that the combustion air may below along part of the motor, and moreover the motor and motor case are coupled with a plate having an opening to form a closed space having only the opening between the motor and motor case (see FIG. 17). As a result, by the action of varying the acoustic condition of the combustion apparatus, and the action of absorbing the pressure fluctuations, oscillatory combustion can be prevented.

Referring now to FIG. 17, the constitution and operation of the embodiment are described specifically below, mainly relating to the difference.

Pressure waves generated by the flame in the burner 8 as mentioned above progress along the motor shaft 4. The pressure waves are changed in the running direction by the motor 3, and collide against the motor case 5. Consequently, the motor case 5 becomes a closed end of acoustic element, where reflection occurs. The reflected pressure waves advance toward the flame of the burner 8 again, and influence the flame surface, thereby becoming a new cause of pressure wave generation.

In such mechanism, pressure fluctuations are fed back, and waves of the frequency coinciding with the acoustic characteristic of the combustion apparatus cause oscillatory combustion. Therefore, oscillatory combustion can be arrested by absorbing the pressure fluctuations and varying the acoustic characteristics.

In the embodiment, an opening g 1201 is provided in order to absorb pressure fluctuations, and a notch disk 1202 as a second coupling member of the invention notched in the junction portion with a path defining plate 1203 mentioned below is provided in the motor case 5. By this constitution alone, however, closed space is not formed between the notch disk 1202 and motor case 5, and Helmholtz sound absorbing device is not composed, and therefore the path defining plate 1203 as the first coupling member of the invention is provided at the intake tube 2 which is the air intake port. In this way, a closed space of volume Vg is formed between the motor case 5 and the notch disk 1202 joined with the path defining plate 1203, and supposing the equivalent diameter of one hole of the opening g 1201 to be dg, the plate thickness of the notch disk 1202 to be tg, and the total area of the opening g 1201 of the notch disk 1202 to be Sg, the sound absorbing effect is obtained at the frequency fg as expressed below, where Cair is the sonic speed in air.

$$fg = (C\text{air}/(2\pi))\sqrt{(Sg/(Vg \cdot lg))}\quad \text{, where } lg = tg + 0.8dg$$

Therefore, by setting the volume Vg and area Sg, and others so that fg may coincide with the frequency of the oscillatory combustion occurring without installation of Helmholtz sound absorbing device, pressure fluctuations at the same frequency are absorbed, and the oscillatory combustion can be prevented.

Besides, by installing the path defining plate 1203 and notch disk 1202, the progressing route of the pressure waves is changed, and the acoustic characteristic of the combustion apparatus alters. Hence, the feedback frequency varies, and there is a difference from the fluctuation frequency in the flame, so that it is also effective to prevent generation of oscillatory combustion.

(Embodiment 8)

Figure 18B:
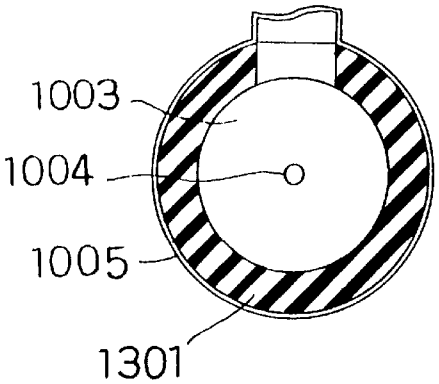
FIGS. 18*a* and 18*b* (referred to collectively as FIG. 18) are structural diagrams of a combustion apparatus of FF type space heater in a different embodiment of the invention.
Figure 18A:
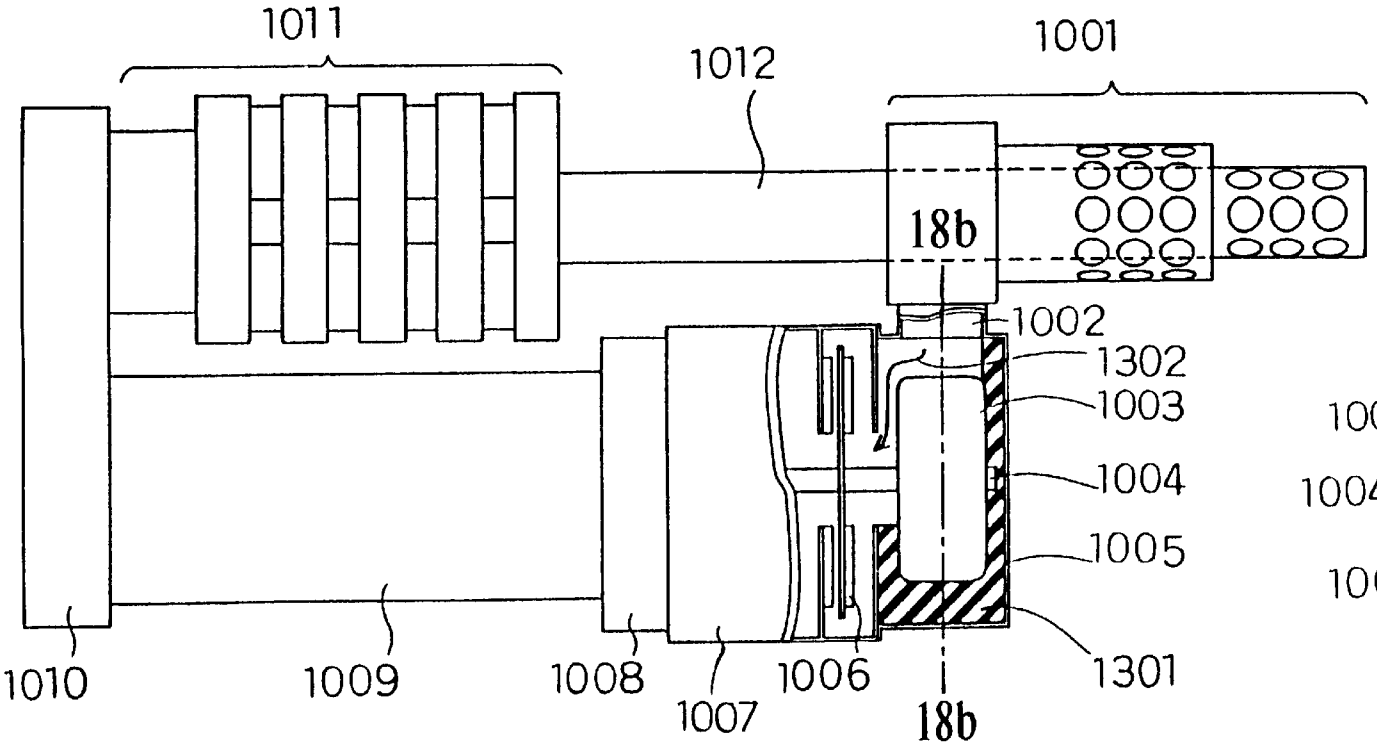

FIG. 18 is a structural diagram of a combustion apparatus of an FF type space heater in a different embodiment of the other aspect of the invention.

A principal difference of the embodiment from FIG. 29 is, as shown in FIG. 18, that a sound absorbing material is installed in the space between the motor and motor case in order to prevent oscillatory combustion, while keeping a path from the intake port of combustion air into the fan. As a result, by the action of varying the acoustic condition of the combustion apparatus, and the action of absorbing the pressure fluctuations, oscillatory combustion can be prevented.

Referring now to FIG. 18, the constitution and operation of the embodiment are described specifically below, mainly relating to the difference.

Pressure waves generated by the flame in the burner 8 as mentioned above progress in the direction of the motor shaft 4. The pressure waves collide against the motor case 5. Consequently, the motor case 5 becomes a closed end of acoustic element, where reflection occurs. The reflected pressure waves advance toward the flame of the burner 8 again, and influence the flame surface, thereby becoming a new cause of pressure wave generation.

In such mechanism, pressure fluctuations are fed back, and waves of the frequency coinciding with the acoustic characteristic of the combustion apparatus cause oscillatory combustion. Therefore, oscillatory combustion can be arrested by absorbing the pressure fluctuations and varying the acoustic characteristics.

In the embodiment, in order to absorb pressure fluctuations, a sound absorbing rubber 1301 as a sound absorbing material of the invention is installed so as to fill up the space between the motor 3 and motor case 5 while keeping an air path 1303. The sound absorbing rubber 1301, different from the Helmholtz sound absorbing device exhibiting a remarkable sound absorbing effect on a specific frequency, is effective to absorb sound over a wide range of frequencies. Incidentally, the Helmholtz sound absorbing device is effective on oscillatory combustion large in the amplitude of pressure fluctuations, while the sound absorbing rubber 1301 is effective on oscillatory combustion of relatively narrow amplitude of pressure fluctuations. By thus installing the sound absorbing rubber 1301, the air passing route is extremely different from that before installation, and hence the progressing route of the pressure waves is changed, and the acoustic characteristic of the combustion apparatus alters. Hence, the feedback frequency varies, and there is a difference from the fluctuation frequency in the flame, so that it is also effective to prevent generation of oscillatory combustion.

(Embodiment 9)

Figure 19B:
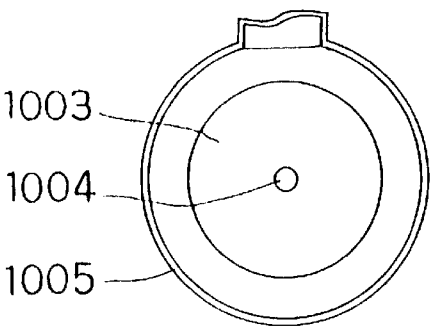
FIGS. 19*a* and 19*b* (referred to collectively as FIG. 19) are strucutral diagrams of a combustion apparatus of FF type space heater in other different embodiment of the invention.
Figure 19A:
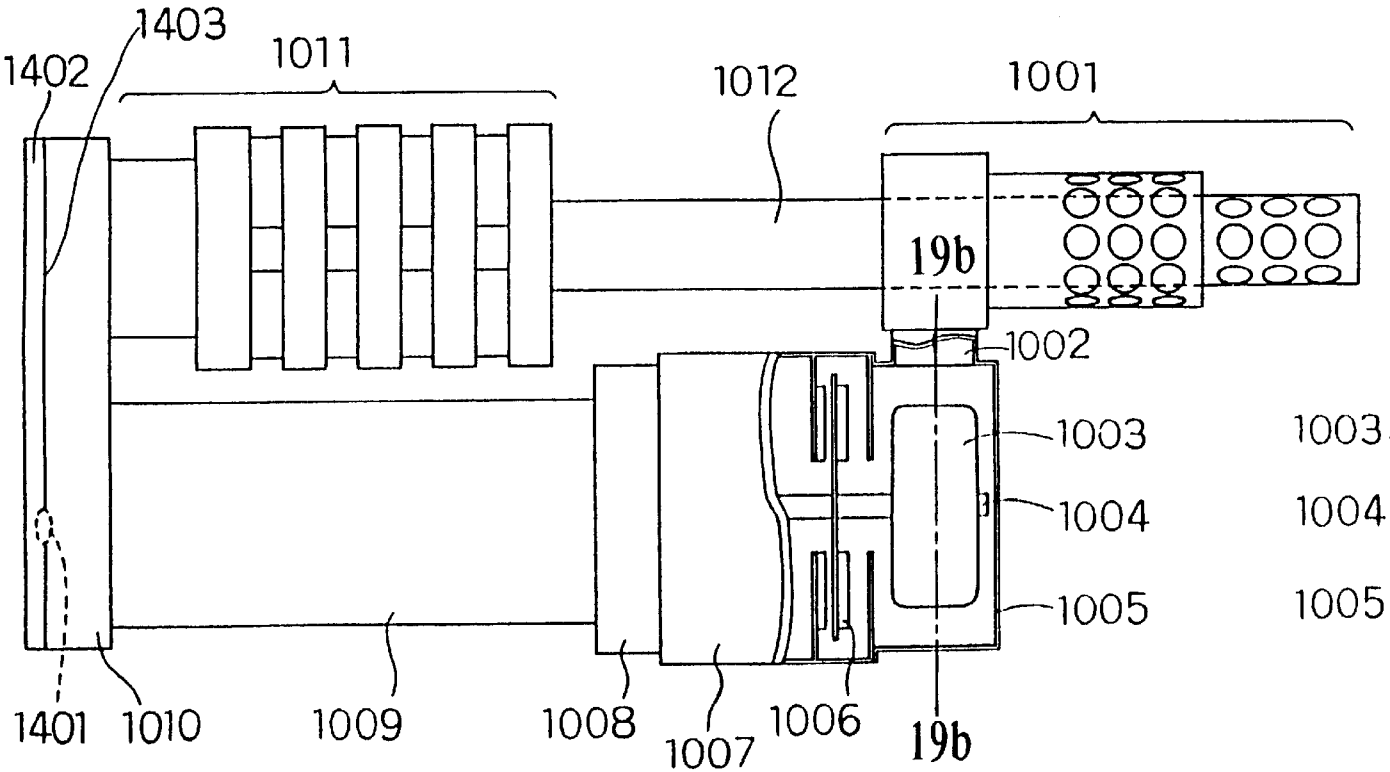

FIG. 19 is a structural diagram of a combustion apparatus of an FF type space heater in a different embodiment of the other aspect of the invention.

A principal difference of the embodiment from FIG. 29 is, as shown in FIG. 19, that, in order to prevent oscillatory combustion, a plate member 1403 having an opening h 1401 with an area s is provided in a return header 1010 as a path of the invention, and that a space I 1402 with a volume v is formed between the plate member 1403 and side wall of the return header 1010 (see FIG. 19). As a result, a Helmholtz type silencer is formed, and supposing the plate thickness of the plate member 1403 having the opening h 1041 to be th and the sonic speed in combustion gas to be Cburn, an extreme sound absorbing characteristic is exhibited at $$fh = (C\text{burn}/(2\pi))\sqrt{(Sh/(Vh \cdot lh))}$$

where lh=th+0.8 dh is an equivalent plate thickness, and dh is an equivalent diameter of the opening h 1401.

By setting the volume Vh and area Sh and others so that the oscillatory combustion frequency and fh may coincide, pressure fluctuations are absorbed, and oscillatory combustion is prevented.

(Embodiment 10)

Figures 20A, 20B:
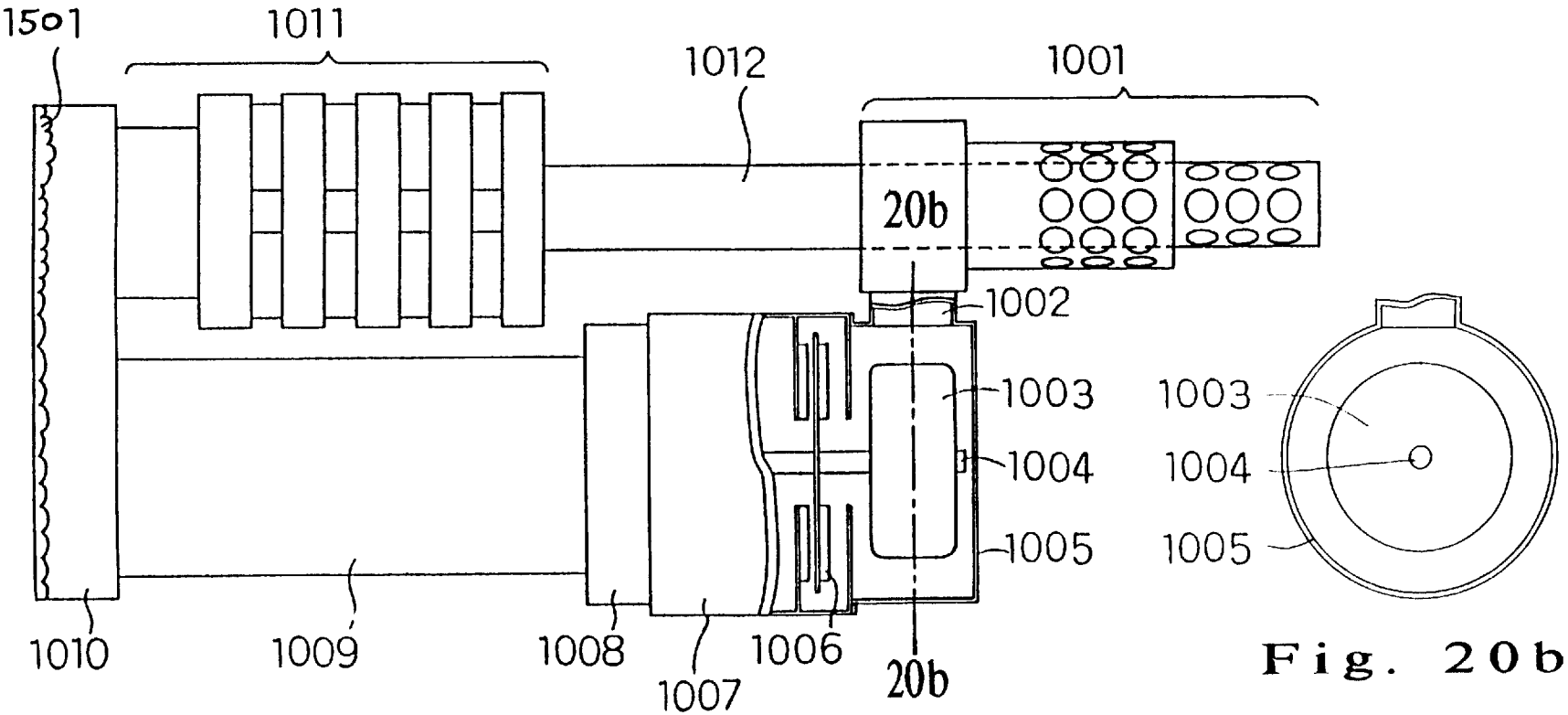
FIGS. 20*a* and 20*b* (referred to collectively as FIG. 20) are structural diagrams of a combustion apparatus of FF type space heater in another embodiment of the invention.

FIG. 20 is a structural diagram of a combustion apparatus of an FF type space heater in a different embodiment of the other aspect of the invention.

A principal difference of the embodiment from FIG. 29 is, as shown in FIG. 20, that, in order to prevent oscillatory combustion, ceramic wool 1501 as sound absorbing material of the invention is provided in a return header 1010. This is a heat resisting fibrous substance, and also possesses sound absorbing characteristic. Therefore, the sound wave is absorbed and reflection amount decreases. As the amount of reflected sound waves decreases, feedback of pressure fluctuations is difficult, so that oscillatory combustion does not occur.

(Embodiment 11)

Figure 21B:
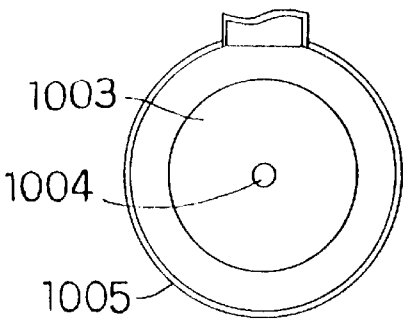
FIGS. 21*a* and 21*b* (referred to collectively as FIG. 21) are structural diagrams of a combustion apparatus of FF type space heater in a further different embodiment of the invention.
Figure 21A:
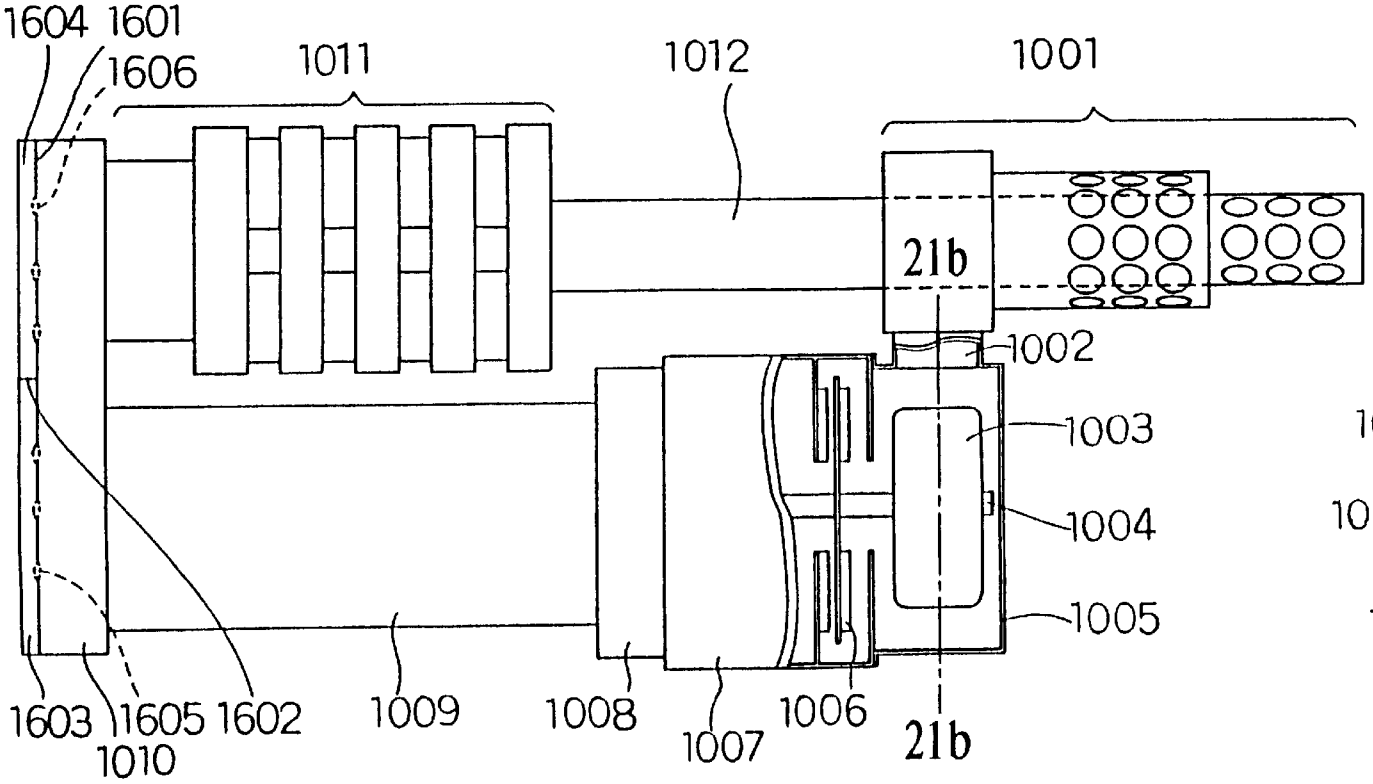

FIG. 21 is a structural diagram of a combustion apparatus of an FF type space heater in a different embodiment of the other aspect of the invention.

A principal difference of the embodiment from FIG. 29 is, as shown in FIG. 21, that, in order to prevent oscillatory combustion, a punching metal 1601 as plate member of the invention is provided in a return header 1010 as path Y of the invention, and that a space j 1603 and a space k 1604 are provided by installing a flow shielding plate 1602 nearly in vertical direction to the flow direction of combustion gas in the return header 1010 (see FIG. 21). Incidentally, the path Z of the invention corresponds to the heat exchanger 1011 shown in FIG. 21. As a result, the combustion gas does not flow from the space j 1603 into the space k 1604, and the space j 1603 and space k 1604 form a Helmholtz silencer. Supposing the total area of the opening of the punching metal in the space j 1063 and space k 1604 to be respectively Sj, Sk, the volume of the space j 1603 to be Vj, the volume of the space k 1604 to be Vk, the plate thickness of the punching metal to be t, and the sonic speed in combustion gas to be Cburn, the space j 1603 has an extreme sound absorbing characteristic at frequency $$fj = (C\text{burn}/(2\pi))\sqrt{(Sj/(Vj \cdot lj))}$$

and the space k 1604 has an extreme sound absorbing characteristic at frequency $$fk = (C\text{burn}/(2\pi))\sqrt{(Sk/(Vk \cdot lk))}$$

where lj=t+0.8 dj, lk=t+0.8 dk are equivalent plate thicknesses, and dj, dk are equivalent diameters of the opening m 1605 and opening n 1606 of one punching metal. By setting the volume, area and others so that the oscillatory combustion frequency may coincide with fj and fk, pressure fluctuations are absorbed, and oscillatory combustion is prevented. In the embodiment, since there are two spaces, there are two frequencies fj, fk to be absorbed, but the silencing effect is greater at the frequency fj as the sound absorbing characteristic of the space j 1603 provided at the place directly exposed to pressure waves. Incidentally, by installing a plurality of flow shielding plates and adjusting the installing positions, the sound absorbing effect is exhibited at plural frequencies, but when combustion gas flows in the Helmholtz space, the space extremely lowers the characteristic of Helmholtz sound absorbing device, and the sound absorbing effect is eliminated. In this constitution, combustion gas does not flow from the space j 1603 into the space k 1604, and temperature rise of the return header 1010 is prevented.

In the embodiment, ceramic wool is used as the sound absorbing material having heat resistance, but not limiting to this, stainless steel wool may be used where heat resistance is required, or, if heat resistance is not required, aside from the sound absorbing rubber, ceramic wool, stainless wool and other sound absorbing material may be used.

In the embodiment, the Helmholtz type silencer (as shown in FIG. 17) can also be included in the embodiment shown in FIG. 21. The Helmoltz Silencer is formed by installing the notch disk 1202 having opening g 1201 and flow. defining plate 1203 in the combustion apparatus, but not limiting to this, for example, by eliminating the opening of the notch disk 1202, and attaching the flow defining plate 1203 to partition inside the motor case 5, the acoustic characteristic of the combustion apparatus can be changed, and, in short, a partitioning member for partitioning the inside space of the combustion mechanism is provided at specified position of the combustion mechanism for generating oscillatory combustion, and the acoustic characteristic of the combustion mechanism may be varied by this partitioning member, thereby reducing the oscillatory combustion.

The embodiment relates to the combustion apparatus of FF type space heater, but not limiting to this, for example, the combustion apparatus may be applied in water heater and the like.

As clear from the description herein, it is an advantage of the invention that the noise and oscillation generated from the combustion apparatus can be further decreased as compared with the prior art.

More different embodiments of the other aspect of the invention are described below while referring to the drawings.

The following embodiment relates to embodiment 5. A main difference between this embodiment and embodiment 5 is that a plate of concave shape is used as the outlet reflection surface of the invention.

(Embodiment 12)

Figure 22:
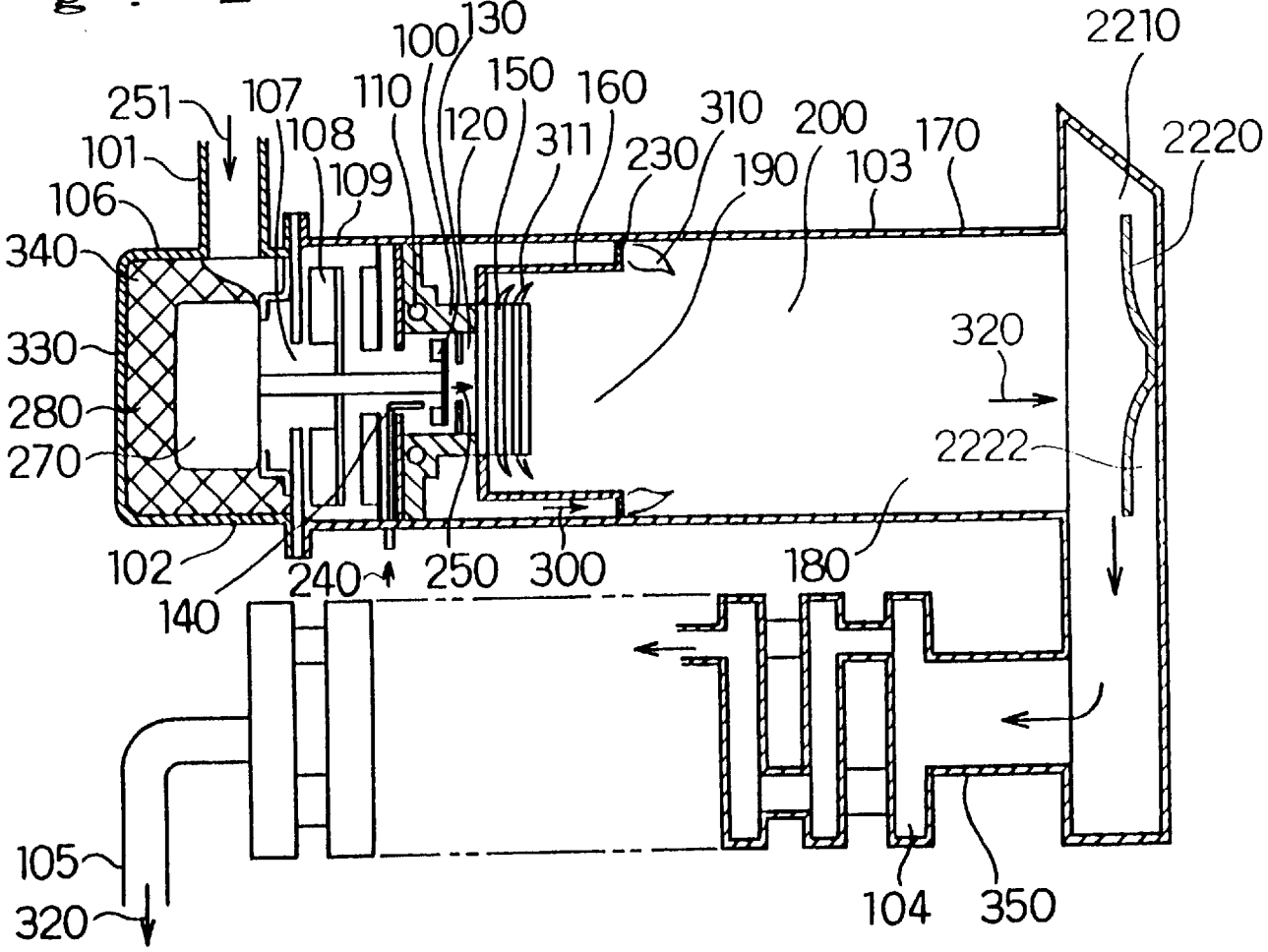
FIG. 22 is a structural diagram of a combustion apparatus in an embodiment of the invention.

FIG. 22 is a sectional detailed diagram of an embodiment of a combustion apparatus of the invention. Basically same components as in embodiment 5 are identified with same reference numerals as used in FIG. 7 and others, and their explanations are omitted.

As shown in the drawing, an outlet reflection surface 2220 is placed inside a return header 2210, and faces the combustion chamber 180. There is a gap 2222 between the return header 2210 and outlet reflection surface 2220. The outlet reflection surface 2220 has the surface area wider than the sectional area of the combustion tube 170, and its middle part is formed as a plate having a concave surface toward the combustion chamber 180. That is, as the configuration, the combustion chamber is located at the facing side of the concave part. The other constitution is same as in embodiment 5.

Incidentally, the bottom of the inlet buffer chamber 280 is an inlet reflection surface 330. In the inlet buffer chamber 280, an inlet sound absorbing unit 340 made of sound absorbing material is provided. The inlet of the inlet buffer chamber 280 and outlet of the return head 2210 are nearly vertical to the inlet reflection surface 330 and outlet reflection surface 2220, and their sectional area is preferred to be as small as possible. The combustion chamber 180 and heat exchanger 104 are connected through return header 2210 and communication tube 350. To form a closed end acoustically at the outlet reflection surface 2220, the sectional area of the communication tube 350 should be as small as possible. If too small, however, the flow resistance of the combustion gas 320 increases, and the noise increases in order to raise the capacity of the blower unit 102. Therefore, a necessary sectional area of the communication tube 350 must be maintained in order to satisfy the closed end.

Since the combustion gas 320 is high in temperature, meanwhile, if directly hitting against the return header 2210, it is injured. When injured, the combustion gas 320 leaks, and the control device in the combustion unit is damaged. Accordingly, a gap 2222 is formed between the outlet reflection surface 2220 and return header 2210, and it is effective also to prevent damage of the return header 2210.

In the embodiment, the intake-exhaust tube in the same structure as in FIG. 8 explained in embodiment 5 is used. Therefore, same as in the foregoing embodiments, in the combustion apparatus of such structure, oscillation does not occur regardless of the length of intake tube 101 and exhaust tube 105.

Figure 23:
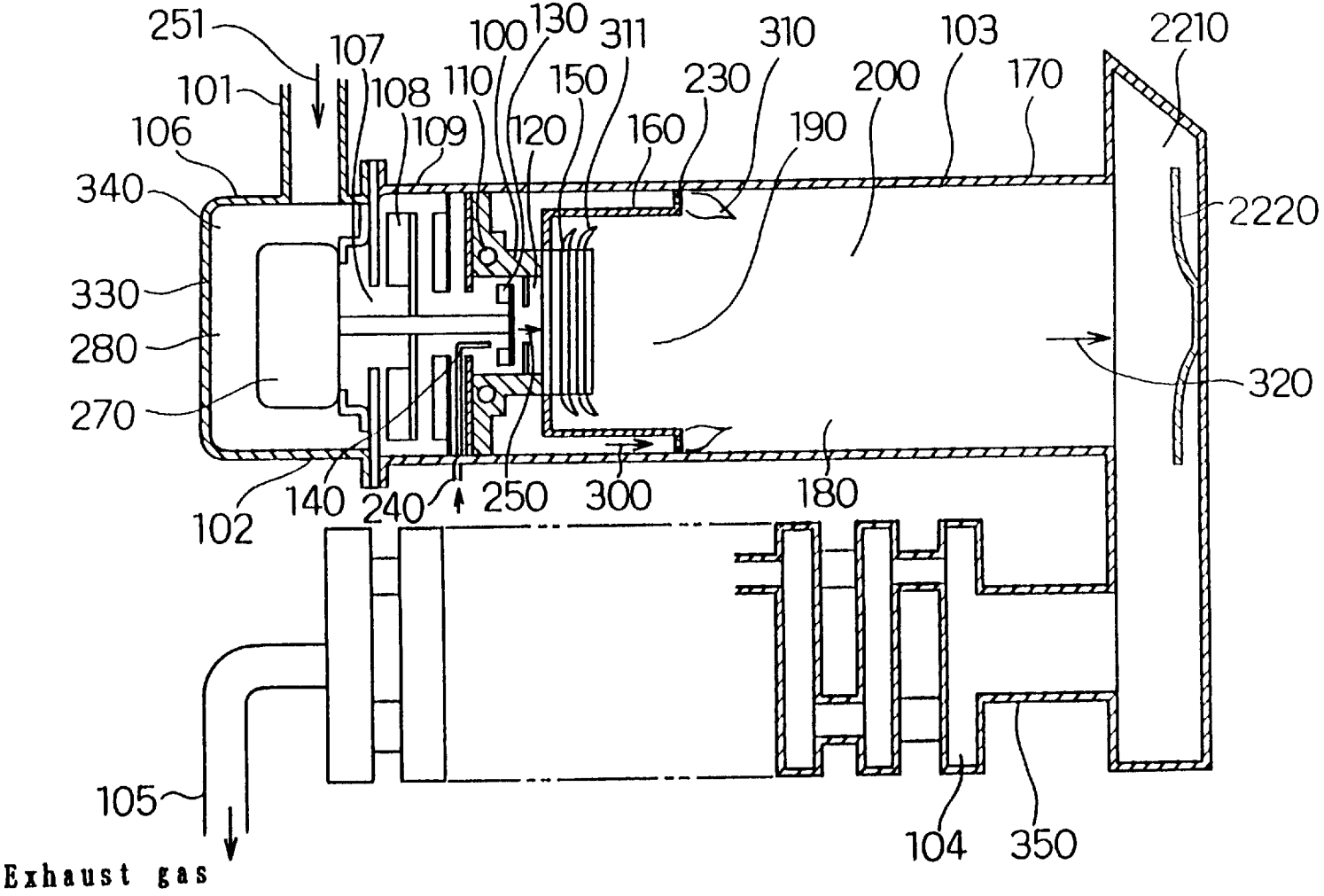
FIG. 23 is a status diagram filled with sound absorbing material in the combustion apparatus.

When the sound absorbing material is removed in FIG. 22, the structure becomes as shown in FIG. 23. The inside of the inlet buffer chamber 280 is a mere free space, and oscillatory combustion occurs during combustion. Vibratory combustion is a oscillation caused when the inlet reflection surface 330 and outlet reflection surface 2220 in the bottom of the inlet buffer chamber 280 are acoustically closed ends.

At this time, to form a securely closed end at the outlet reflection surface 2220, its sectional area is set larger than the area of the combustion tube 170, and the middle portion is formed concave toward the combustion tube 170. By providing it, the sound reflection is directed in the direction of the combustion tube 170, and oscillatory combustion occurs securely. That is, since the outlet reflection surface 2220 is provided as a plate having a concave part, the reflection of sympathetic frequency in the acoustic space in the combustion apparatus in the outlet reflection surface 2220 increases. As a result, oscillatory combustion occurs securely.

When oscillatory combustion occurs, pressure fluctuations of single frequency are detected in the combustion apparatus, and noise at the same frequency is sensed outside the combustion chamber 180, same as in the foregoing embodiments.

By the same reason as in the foregoing embodiments, the length of the air intake tube 101 and exhaust tube 104 has no relation with the oscillatory combustion.

From the state in FIG. 23, when the inlet buffer chamber 280 is filled with sound absorbing material and the structure is formed again as shown in FIG. 22, oscillation does not occur. By the same confirmation test as in the previous embodiments, the same results were obtained. Hence, by preventing oscillations by sound absorption, it is similarly known that oscillation does not occur if the length of the intake tube 101 and exhaust tube 105 is changed.

That is, when acoustic closed ends are formed before and after the premixed flame 311 as shown in FIG. 22, oscillatory combustion in which closed ends are pressure peaks occurs, and the oscillation frequency is determined by the distance between closed ends and the state of the flame. In FIG. 22, although the length of the inlet tube 101 and exhaust tube 105 is variable, the oscillation frequency does not change regardless of the length of the intake tube 101 and exhaust tube 105. Therefore, by absorbing the oscillation by the inlet buffer chamber 280 and suppressing generation of oscillations, oscillation does not occur if the length of the intake tube 101 and exhaust tube 105 is changed. Generally, the sound absorbing material is larger in the sound absorbing and oscillation absorbing effect when the frequency is higher, so that the generated oscillation should be as high as possible in frequency.

In FIG. 22, an inlet throttle 107 is provided at the burner port side of the inlet buffer chamber 280. By this throttle 107, the oscillation in the inlet buffer chamber 280 is in phase, and the pressure is at the antinode on the entire wall. Therefore, when the entire inlet buffer chamber 280 is filled with sound absorbing material, the oscillation suppression effect is very great. When the oscillation passes through this throttle 107 of narrow section, it is attenuated, and the oscillation suppressing effect is great. Inside the mixing chamber 120, the liquid fuel 240 is vaporized, and mixed with combustion air to prepare a premixed gas, but a gas fuel may be used instead. In this case, without rotary, the gas fuel and combustion air are mixed easily, and a uniform premixed gas is obtained.

Figure 24:
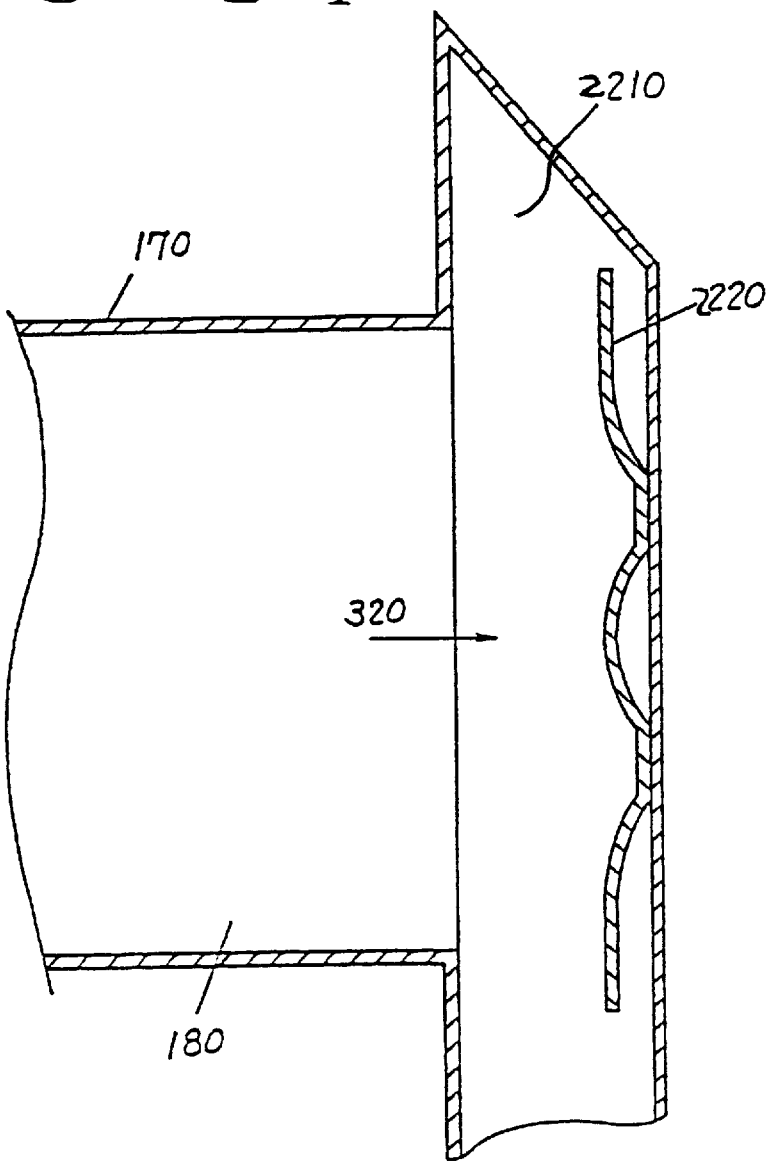
FIG. 24 is a diagram showing a different shape of the outlet reflection surface.
Figure 25A:
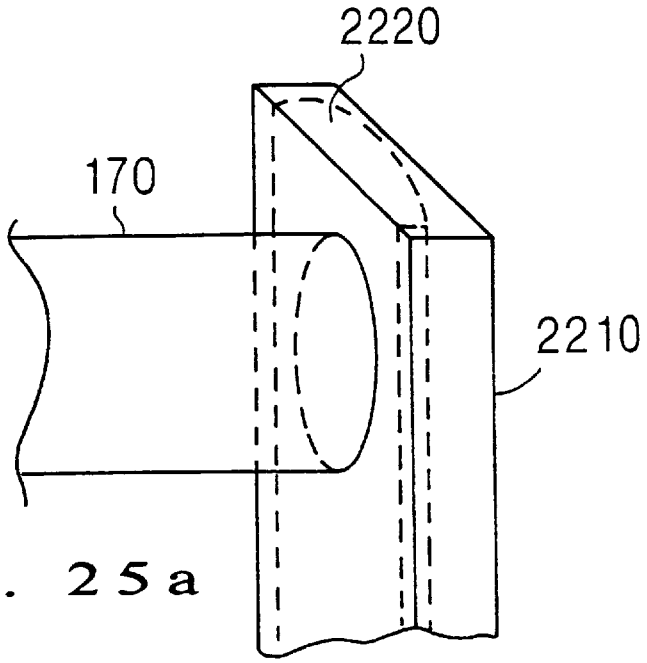
FIGS. 25*a* and 25*b* (referred to collectively as FIG. 25) are diagrams showing other different shape of the outlet reflection surface.
Figure 25B:
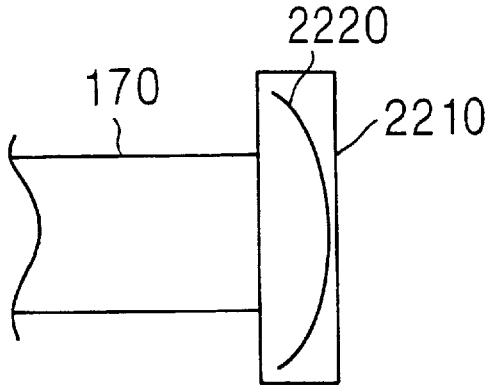
Figure 26A:
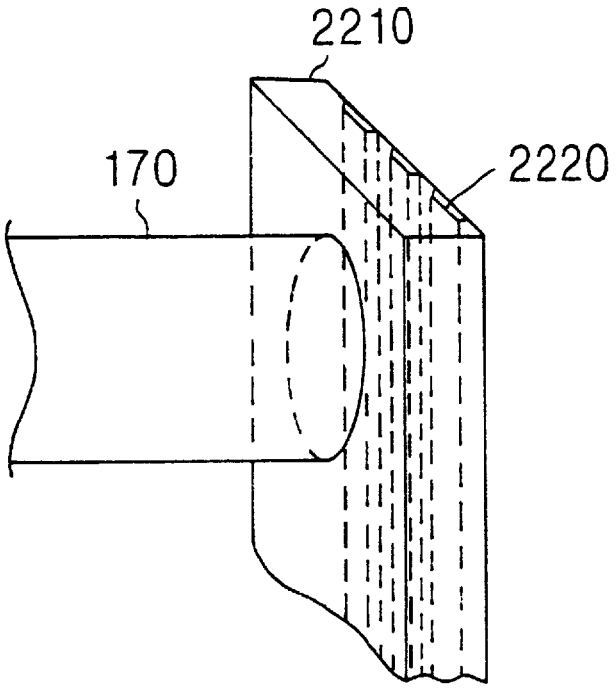
FIGS. 26*a* and 26*b* (referred to collectively as FIG. 26) are diagrams showing a further different shape of the outlet reflection surface.
Figure 26B:
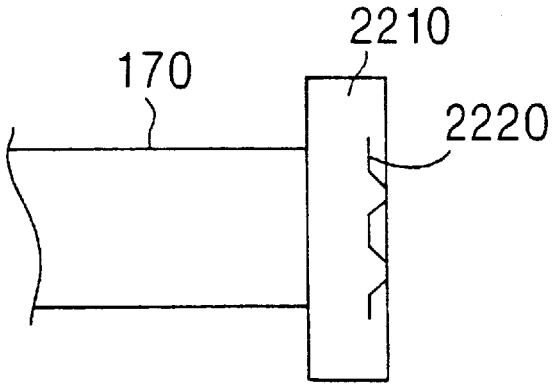

The above explanation is particularly effective when the structure of the combustion apparatus is acoustically one-dimensional. The combustion tube 170 may be bent round. Or as shown in the drawing of the embodiment, the shape of the structures disposed between the reflection surfaces on the central axis of the combustion section (the central axis of the combustion section being in a cylindrical shape) is preferred to be axis symmetrical to the central axis. In the embodiment, the outlet reflection surface 2220 is concave at one position toward the combustion tube 170, but two or more positions may be thus formed as shown in FIG. 24. The concave portion may be either concave in one section as shown in FIG. 25, or trapezoidal as shown in FIG. 26.

The reflection surface for generating acoustic reflection is not a meter plate as understood from the description of the embodiment, but may be called a reflection surface including the buffer chamber.

Figure 27:
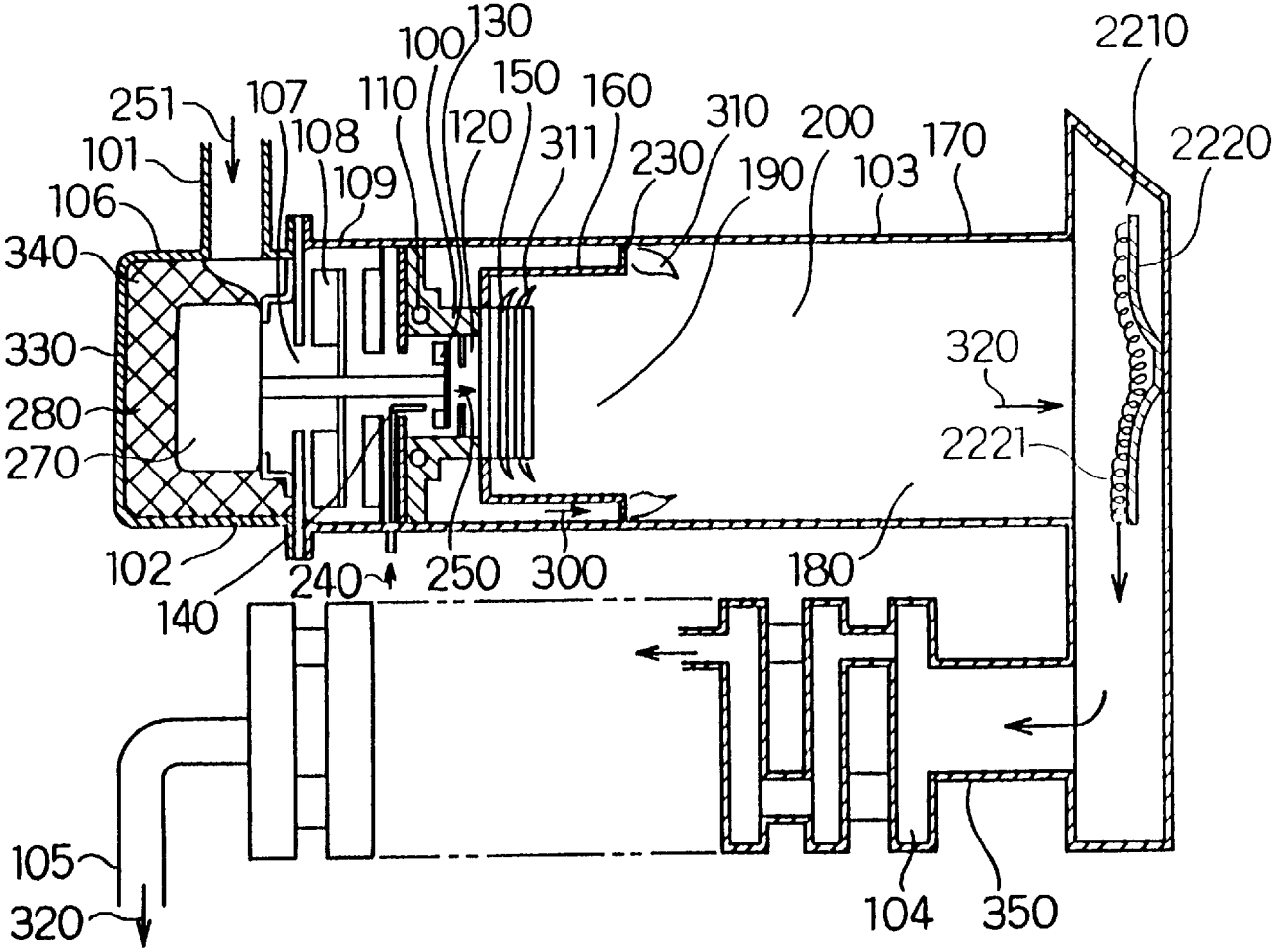
FIG. 27 is a structural diagram of a combustion apparatus in a different embodiment of the invention.

FIG. 27 is a structural diagram of a combustion apparatus in an embodiment of the invention. It is same as in FIG. 22 except that a porous matter 2221 is provided on the surface of the outlet reflection surface 2220. Thus, excluding the sound absorbing material of the inlet sound absorbing unit 340, for example, when set in oscillating state, the porous matter 2221 exhibits a sound absorbing effect, and it is effective to suppress oscillation. This effect is not impeded if the sound absorbing material of the inlet sound absorbing unit 340 is provided, and the quantity of sound absorbing material in the inlet sound absorbing unit 340 can be decreased, and a large sound absorbing effect can be exhibited. At this time, since the temperature of combustion gas is high, the porous matter 2221 is preferred to be composed of ceramics or metal.

(Embodiment 13)

Figure 28:
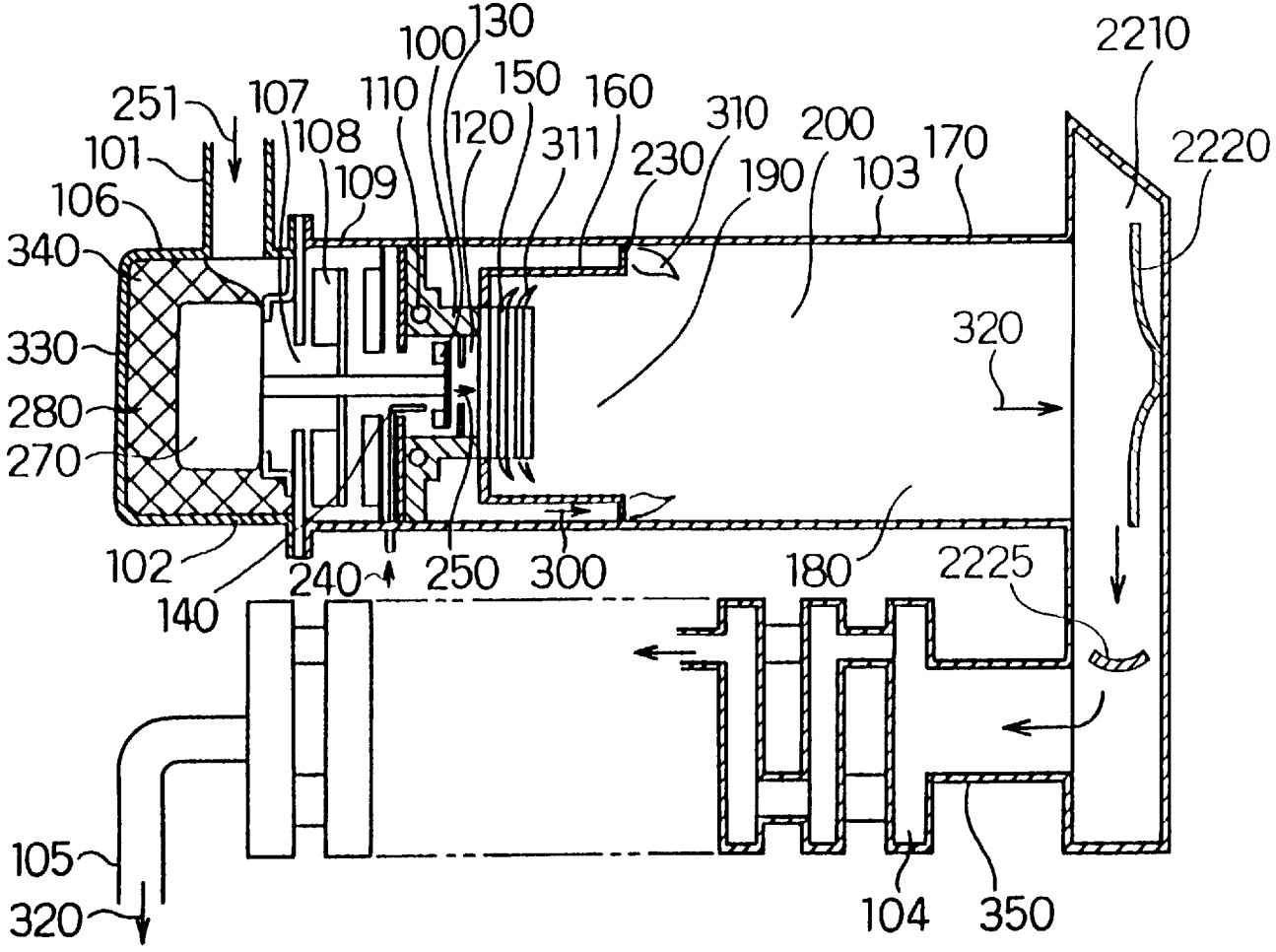
FIG. 28 is a structural diagram of a combustion apparatus in a further different embodiment of the invention.

FIG. 28 is a structural diagram of a combustion apparatus in an embodiment of the other aspect of the invention. It is same as FIG. 22 except that a second outlet reflection surface 2225 is provided. Thus, excluding the sound absorbing material of the inlet sound absorbing unit 340, for example, when set in oscillating state, sound waves not fully reflected by the outlet reflection surface 2220 are reflected by the second reflection surface 2225. Hence, oscillatory combustion is likely to occur, and take place in specific conditions. To exhibit this effect, the distance between the outlet reflection surface 2220 and outlet second reflection surface 2225 must be the distance corresponding to ½ wavelength of the oscillating frequency.

In this state, when the sound absorbing material of the inlet sound absorbing unit 340 is provided again, the oscillation is absorbed by the sound absorbing material, and oscillatory combustion can be prevented.

As evident from the foregoing embodiments, the invention can easily prevent oscillation by the sound absorbing material in the buffer chamber, by directing the sound reflection securely toward the combustion chamber, and specifying the generating oscillation constant.

Besides, behind the outlet reflection surface, by providing the outlet second reflection surface acoustically behind the ½ wavelength, the sound reflection is more securely directed toward the combustion chamber, and the occurring oscillation may be specific, so that the oscillation may be easily prevented by the sound absorbing material in the buffer chamber.

What is claimed is:

1. A combustion apparatus comprising a combustion section composed of a combustion chamber and a burner port unit, a blower for supplying combustion air into the combustion section, an intake tube connected to the blower side, an exhaust tube connected to the combustion section side, an inlet reflection surface provided at the upstream side of the burner port unit, and an outlet reflection surface provided at the downstream side of the combustion chamber, wherein the inlet reflection surface and the outlet reflection surface form an acoustic space having a sympathetic frequency, said sympathetic frequency is not substantially influenced by changes of size or length of the intake tube and/or the exhaust tube, and sound absorbing means for absorbing sound of specific frequency defined by the sympathetic frequency of the acoustic space is provided on the inlet reflection surface and/or the outlet reflection surface.

2. A combustion apparatus of claim 1, wherein the sound absorbing means is a sound absorbing mechanism of Helmholtz type provided at a specified position of a combustion mechanism for generating oscillatory combustion, and the oscillatory combustion is decreased by this sound absorbing mechanism.

3. A combustion apparatus of claim 2, wherein the blower comprises a motor, a fan mounted on a motor shaft of the motor for supplying the combustion air, a motor case surrounding the motor, an intake port for the combustion air installed in the motor case, and a space formed between the motor and the motor case, the inlet reflection surface is the motor case, the sound absorbing mechanism has a specified opening provided in the motor case, and a space forming member for forming a closed space having the opening provided outside of the motor case, and the motor shaft and a flow direction of the combustion air flowing in the intake port of combustion air are substantially at right angle to each other.

4. A combustion apparatus of claim 2, wherein the blower comprises a motor of a nearly cylindrical shape, a fan mounted on a motor shaft of the motor for supplying combustion air, a motor case surrounding the motor, an intake port for combustion air installed in the motor case, and a space formed between the motor and the motor case, further comprising:

a first coupling member installed substantially parallel to a flow direction of the combustion air flowing in the intake port of combustion air, for defining the flow so that the combustion air may flow along part of the motor, thereby coupling the intake port of combustion air and side of the motor, and a second coupling member having a specified opening for coupling the motor and motor case, the sound absorbing mechanism is a closed space having the opening, formed between the motor and the motor case, by making use of the first coupling member and the second coupling member, and the motor shaft and the flow direction of the combustion air flowing in the intake port of combustion air are substantially at right angle to each other.

5. A combustion apparatus of claim 2, further comprising:

a path provided at a downstream side of the combustion chamber for changing a flow direction of all or part of a combustion gas substantially in vertical direction on the basis of the flow direction of the combustion gas in the combustion chamber, and a plate member having a specific opening, provided substantially at right angle to the flow direction of the combustion gas in the path, wherein the sound absorbing mechanism is a closed space having the opening, formed in the path by the plate member, and the motor shaft and the flow direction of the combustion air flowing in the intake port of the combustion air are substantially at right angle to each other.

6. A combustion apparatus of claim 2, further comprising:

a path Y for changing a flow direction of all or part of combustion gas substantially in vertical direction on the basis of the flow direction of the combustion gas in the combustion chamber, a path Z coupled to the path Y, so as to be substantially parallel to the combustion chamber in the same direction as a direction of installation of the combustion chamber, on the basis of the path Y, and a plate member having plural openings, provided in the path Y, wherein the sound absorbing mechanism is a closed space having the openings, formed in the path Y, by making use of the plate member, and a flow shielding plate is provided in the closed space, substantially at right angle to a flow direction of combustion gas in the path Y.

7. A combustion apparatus of claim 1, wherein the sound absorbing means is a sound absorbing member provided in a specified position of a combustion mechanism in which oscillatory combustion occurs, and the acoustic characteristic of the combustion mechanism is changed by the sound absorbing member, thereby reducing the oscillatory combustion.

8. A combustion apparatus of claim 7, wherein the blower comprises a motor, a fan mounted on a motor shaft of the motor for supplying the combustion air, a motor case surrounding the motor, an intake port for the combustion air installed in the motor case, and a space formed between the motor and the motor case, the sound absorbing material is provided in a space between the motor and the motor case, while keeping a path at least from the intake port of the combustion air to the fan, and the motor shaft and a flow direction of the combustion air flowing in the intake port of combustion air are substantially at right angle to each other.

9. A combustion apparatus of claim 7, wherein a path for changing a flow direction of all or part of combustion gas substantially in a vertical direction on the basis of the flow direction of the combustion gas in the combustion chamber is provided at a downstream side of the combustion chamber, and the sound absorbing member is made of heat-resistant material, and is provided in a position in the path so that the combustion gas passing through the combustion chamber may collide substantially at right angle.

10. A combustion apparatus of claim 1, wherein the inlet reflection surface and the outlet reflection surface do not confront each other.

11. A combustion apparatus of claim 10, wherein the inlet reflection surface and/or the outlet reflection surface has a buffer space.

12. A combustion apparatus of claim 1, wherein the inlet reflection surface and/or the outlet reflection surface has a buffer space.

13. A combustion apparatus of claim 1, wherein size or length of the intake tube and the exhaust tube is variable.

14. A combustion apparatus of claim 13, wherein the inlet of the intake tube and the outlet of the exhaust tube are acoustically open.

15. A combustion apparatus of claim 1, wherein a shape of structures between the reflectors disposed on a central axis between the reflectors is axis symmetrical to the central axis.

16. A combustion apparatus of claim 1, wherein the outlet reflection surface is provided inside a combustion gas passage at the downstream side of the combustion chamber, and there is a specified gap against a wall of the combustion gas passage.

17. A combustion apparatus of claim 16, wherein the outlet reflection surface has a concave part, and the combustion chamber is present at the facing side of the concave part.

18. A combustion apparatus of claim 16, wherein a porous matter is attached to a surface of the outlet reflection surface.

19. A combustion apparatus of claim 16, wherein an outlet second reflection surface is provided in the combustion gas passage at a position remote from the outlet reflection surface to a downstream side by a distance corresponding to ½ wavelength of the sympathetic frequency.

20. A combustion apparatus comprising:

intake means for supplying combustion air, a burner unit for burning mixed gas of the supplied combustion air and fuel, a combustion tube provided downstream of the burner on the basis of flow of the combustion air, a heat exchanger provided downstream of the combustion tube, for exchanging heat at least with combustion gas generated by the burner, coupling means for coupling the heat exchanger and the combustion tube, said intake means, said burner unit, said combustion tube, said heat exchanger, and said coupling means forming an inner space having an acoustic characteristic, and a partitioning member provided at a specified position in the inner space for partitioning the inner space and changing the acoustic characteristic.

21. The combustion apparatus according to claim 20 wherein the partitioning member has an opening.

22. A combustion apparatus comprising a combustion section composed of a combustion chamber and a burner port unit, a blower for supplying combustion air into the combustion section, an inlet reflection surface provided at an upstream side of the burner port unit, an intake tube communicating with the blower, an outlet reflection surface provided at an outlet side of the combustion chamber, facing the burner port unit, an exhaust tube provided almost vertically to the outlet reflection surface, and a sound absorbing member provided on the inlet reflection surface.

23. A combustion apparatus of claim 22, wherein a sound absorbing member is provided at the outlet reflection surface.

24. A combustion apparatus of claim 23, wherein the sound absorbing member of the inlet reflection surface and the sound absorbing member of the outlet reflection surface are different in the sound absorbing characteristics.

25. A combustion apparatus of claim 22, wherein a heat exchanger is installed between the combustion chamber and the outlet reflection surface.

26. A combustion apparatus of claim 22, wherein a heat exchanger is installed at the outlet of the combustion chamber.

27. A combustion apparatus comprising a combustion section composed of a combustion chamber and a burner port unit, a blower for supplying combustion air into the combustion section, an inlet buffer chamber provided between the blower and the burner port unit, an intake tube communicating with the blower, an outlet reflection surface provided at an outlet side of the combustion chamber, and an exhaust tube provided at the outlet side of the combustion chamber, wherein an inlet sound absorbing unit having a sound absorbing member is provided in the inlet buffer chamber.

28. A combustion apparatus of claim 27, wherein an outlet buffer chamber communicating with the exhaust tube is provided at the outlet side of the combustion chamber.

29. A combustion apparatus of claim 28, wherein an outlet sound absorbing unit having a sound absorbing member is provided in the outlet buffer chamber.

30. A combustion apparatus of claim 29, wherein the sound absorbing member of the inlet buffer chamber and the sound absorbing member of the outlet buffer chamber are different in the sound absorbing characteristics.

31. A combustion apparatus comprising a combustion section composed of a combustion chamber and a burner port unit, a blower for supplying combustion air into the combustion section, an inlet buffer chamber provided between the blower and the burner port unit, an intake tube communicating with the blower, an outlet reflection surface provided at an outlet side of the combustion chamber and communicating with an exhaust tube, and an inlet sound absorbing unit having a sound absorbing member in the inlet buffer chamber, wherein a throttle is provided at the burner port side of the inlet buffer chamber.

32. A combustion apparatus of claim 31, wherein an outlet buffer chamber is provided at the outlet side of the combustion chamber, and a throttle is provided between the outlet buffer chamber and the combustion chamber.

33. A combustion apparatus comprising:

a combustion section composed of a combustion chamber and a burner port unit, a blower for supplying combustion air into the combustion section, a motor case incorporating a motor provided in the blower, a fan case incorporating a fan, and a mixing chamber between the motor and the burner port unit, an inlet buffer chamber provided between the motor case and the motor, a sound absorbing unit provided in the inlet buffer chamber, being filled with sound absorbing member, a throttle provided between the motor case and the fan, and an outlet reflection plate provided at the outlet of the combustion chamber, wherein the burner port unit has multiple burner ports provided at a side wall of cylindrical shape, and the combustion chamber has a combustion plate possessing secondary air vents and forming a primary combustion chamber, and a secondary combustion tube for forming a secondary combustion chamber.

34. A combustion apparatus of claim 33, wherein an intake tube is provided in the motor case, and a communication tube is provided at the outlet of the combustion tube.

35. A combustion apparatus of claim 33, wherein the burner port unit projects from the combustion plate to the primary combustion chamber.

36. A combustion apparatus comprising:

a combustion section composed of a combustion chamber and a burner port unit, a blower for supplying combustion air into the combustion section, a motor case incorporating a motor provided in the blower, a fan case incorporating a fan, and a vaporizing tube incorporating a rotary between the motor and the burner port unit, an inlet buffer chamber provided between the motor case and the motor, a sound absorbing unit provided in the inlet buffer chamber, being filled with sound absorbing member, a throttle provided between the motor case and the fan, and an outlet reflection plate provided at an outlet of the combustion chamber, wherein the burner port unit has multiple burner ports provided at the side wall of the burner port shape, and the combustion chamber has a combustion plate possessing secondary air vents and forming a primary combustion chamber, and a secondary combustion tube for forming a secondary combustion chamber.

37. A combustion apparatus of claim 36, wherein an intake tube is provided in the motor case, and a communication tube is provided at the outlet of the combustion tube.

38. A combustion apparatus of claim 36, wherein the burner port unit projects from the combustion plate to the primary combustion chamber.

39. A combustion apparatus comprising:

a combustion section composed of a combustion chamber and a burner port unit, a blower for supplying combustion air into the combustion section, a motor case incorporating a motor, being provided in the blower, a fan case incorporating a fan, being provided in the blower, a vaporizing tube incorporating a rotary provided between the motor and the burner port unit, an inlet buffer chamber provided between the motor case and the motor, and a throttle provided between the motor case and the fan, wherein the combustion chamber has a combustion plate having secondary air vents for forming a primary combustion chamber and a combustion tube for forming a secondary combustion chamber, an outlet of the combustion tube is open, the burner port unit projects into the primary combustion chamber, and a ratio of an acoustic length from the burner port unit to an upstream side and the acoustic length from the burner port unit to a downstream side is set at a specific ratio capable of preventing oscillatory combustion.

40. A combustion apparatus of claim 39, wherein the burner port unit has multiple burner ports provided in a side wall of cylindrical shape.

41. A combustion apparatus of claim 39, wherein the burner ports and combustion plate confront each other.

42. A combustion apparatus of claim 39, wherein a shape of structures between the combustion tube outlet and reflector disposed on a central axis between the combustion tube outlet and reflector is axis symmetrical to the central axis.

43. A combustion apparatus comprising:

a combustion section composed of a combustion chamber and a burner port unit, a blower for supplying combustion air into the combustion section, a motor case incorporating a motor, being provided in the blower, a fan case incorporating a fan, being provided in the blower, a vaporizing tube incorporating a rotary provided between the motor and the burner port unit, an inlet buffer chamber provided between the motor case and the motor, a sound absorbing unit filled with a sound absorbing member, being provided in the inlet buffer chamber, and a throttle provided between the motor case and the fan, wherein the burner port unit has multiple burner ports provided in a side wall of cylindrical shape, the combustion chamber has a combustion plate having secondary air vents for forming a primary combustion chamber and a combustion tube for forming a secondary combustion chamber, an outlet of the combustion tube is open, the burner port unit projects into the primary combustion chamber, and a ratio of an acoustic length from the burner port unit to an upstream side and the acoustic length from the burner port unit to a downstream side is set at a specific ratio capable of preventing oscillatory combustion.

44. A combustion apparatus of claim 43, wherein an intake tube communicates with the motor case, and an exhaust tube communicates with the combustion chamber.

45. A combustion apparatus of claim 43, wherein a shape of structures between the combustion tube outlet and reflector disposed on a central axis between the combustion tube outlet and reflector is axis symmetrical to the central axis.

* * * * *